US012297070B2

(12) United States Patent
Galindo Gonzalez et al.

(10) Patent No.: US 12,297,070 B2
(45) **Date of Patent: *May 13, 2025**

(54) ROTATABLE CABLE REEL

(71) Applicant: Southwire Company, LLC, Carrollton, GA (US)

(72) Inventors: Juan Alberto Galindo Gonzalez, Powder Springs, GA (US); Franklin Clarence Calhoun, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 395 days.

This patent is subject to a terminal disclaimer.

(21) Appl. No.: 17/838,474

(22) Filed: Jun. 13, 2022

(65) Prior Publication Data

US 2022/0306422 A1 Sep. 29, 2022

Related U.S. Application Data

(60) Division of application No. 16/390,733, filed on Apr. 22, 2019, now Pat. No. 11,358,831, which is a (Continued)

(51) Int. Cl.
*B65H 75/14* (2006.01)
*B65H 75/24* (2006.01)
(Continued)

(52) U.S. Cl.
CPC ..... *B65H 75/14* (2013.01); *B65H 75/146* (2013.01); *B65H 75/241* (2013.01); *B65H 75/30* (2013.01);
(Continued)

(58) Field of Classification Search
CPC ..... B65H 75/14; B65H 75/30; B65H 75/40; B65H 75/146; B65H 75/241; B65H 75/403; B65H 75/4405; B65H 75/4428
See application file for complete search history.

(56) References Cited

U.S. PATENT DOCUMENTS 308,411 A 11/1884 Harding et al.
465,281 A 12/1891 Meyer
(Continued)

FOREIGN PATENT DOCUMENTS

AT 156245 B 5/1939
FR 2425486 12/1979
(Continued)

OTHER PUBLICATIONS

Canadian Office Action dated Nov. 23, 2022 in Canadian Patent Application No. 2,911,286.
(Continued)

*Primary Examiner* — Sang K Kim
(74) *Attorney, Agent, or Firm* — Hartman & Citrin LLC

(57) ABSTRACT

A cable reel of the present disclosure can include two flanges and a central drum being independently rotatable from one another. The drum, which can be configured to receive a cable, can be mounted on an axle. The two flanges can be rotationally mounted on the axle at opposing distal ends of the axle. Bearings in the flanges can allow for a full rotation of the flanges about the axle.

16 Claims, 24 Drawing Sheets

Related U.S. Application Data continuation of application No. 15/225,357, filed on Aug. 1, 2016, now Pat. No. 10,266,366, which is a continuation of application No. 14/198,348, filed on Mar. 5, 2014, now Pat. No. 9,403,659.

(60) Provisional application No. 61/773,049, filed on Mar. 5, 2013.

(51) Int. Cl.
*B65H 75/30* (2006.01)
*B65H 75/40* (2006.01)
*B65H 75/44* (2006.01)

(52) U.S. Cl.
CPC ..... *B65H 75/40* (2013.01); *B65H 75/403* (2013.01); *B65H 75/4405* (2013.01); *B65H 75/4428* (2013.01); *B65H 2701/34* (2013.01)

(56) References Cited

U.S. PATENT DOCUMENTS

| | | | |
|---|---|---|---|
| 486,010 | A | 11/1892 | Wirt |
| 613,138 | A | 10/1898 | Gempeler |
| 709,932 | A | 9/1902 | Schooley |
| 1,353,541 | A | 9/1920 | Retterer |
| 1,376,114 | A | 4/1921 | Raney |
| 1,445,071 | A | 2/1923 | Collins |
| 1,461,939 | A | 7/1923 | Sager |
| 1,561,160 | A | 11/1925 | Ingenthron |
| 1,661,991 | A | 3/1928 | Benit |
| 1,726,137 | A | 8/1929 | Suarez et al. |
| 1,852,939 | A | 4/1932 | Schmidt |
| 1,858,825 | A | 5/1932 | Hescock |
| 1,949,378 | A | 2/1934 | Roehm |
| 1,961,376 | A | 6/1934 | McIlvried |
| 2,132,043 | A | 10/1938 | Oldham |
| 2,549,224 | A | 4/1951 | Moldovan |
| 2,553,835 | A | 5/1951 | Sachs |
| 2,707,599 | A | 5/1955 | Snyder |
| 2,720,285 | A | 10/1955 | Taylor |
| 2,960,857 | A | 11/1960 | Winter |
| 3,009,667 | A | 11/1961 | Browne |
| 3,152,772 | A | 10/1964 | Schjerven |
| 3,207,456 | A | 9/1965 | Hill |
| 3,298,667 | A | 1/1967 | Grantham et al. |
| 3,393,790 | A | 7/1968 | Dixon |
| 3,405,881 | A | 10/1968 | Sanford et al. |
| 3,450,366 | A | 6/1969 | Goldberg |
| 3,652,026 | A | 3/1972 | Awebro |
| 3,820,733 | A | 6/1974 | Roederer et al. |
| 3,822,841 | A | 7/1974 | Campbell |
| 3,850,382 | A | 11/1974 | Clingerman et al. |
| 3,860,193 | A | 1/1975 | Green |
| 3,976,260 | A | 8/1976 | Irik |
| 3,997,127 | A | 12/1976 | Kovaleski |
| 4,034,933 | A | 7/1977 | Hara et al. |
| 4,124,176 | A | 11/1978 | Carlson et al. |
| 4,126,211 | A | 11/1978 | Blosser |
| 4,164,131 | A | 8/1979 | Desmond |
| 4,176,801 | A | 12/1979 | Douglas |
| 4,183,475 | A | 1/1980 | Martija |
| D254,595 | S | 4/1980 | Hart |
| 4,226,383 | A | 10/1980 | Douglas |
| 4,232,837 | A | 11/1980 | Cutler et al. |
| 4,298,174 | A | 11/1981 | Kovaleski |
| 4,325,522 | A | 4/1982 | Sauber |
| 4,441,586 | A | 4/1984 | Bernier |
| 4,447,012 | A | 5/1984 | Woodruff |
| 4,605,237 | A | 8/1986 | Torgrimson |
| 4,649,724 | A | 3/1987 | Raine |
| 4,746,078 | A | 5/1988 | Setzke |
| 4,747,561 | A | 5/1988 | Sweeney et al. |
| 4,784,221 | A | 11/1988 | Share et al. |
| 4,819,462 | A | 4/1989 | Aspell |
| 4,833,442 | A | 5/1989 | Von Heck |
| 4,917,322 | A | 4/1990 | Combs |
| 4,948,064 | A | 8/1990 | Richard |
| 5,040,739 | A | 8/1991 | Wolf et al. |
| 5,054,745 | A | 10/1991 | Swayze et al. |
| 5,060,882 | A | 10/1991 | Rousculp et al. |
| 5,113,976 | A | 5/1992 | Noakes |
| D347,988 | S | 6/1994 | Thorne |
| 5,490,805 | A | 2/1996 | Bredesen |
| 5,498,940 | A | 3/1996 | Kim et al. |
| 5,628,212 | A | 5/1997 | Fritzler |
| D385,525 | S | 10/1997 | Beavers et al. |
| 5,752,670 | A | 5/1998 | Lasecki et al. |
| 5,758,685 | A | 6/1998 | Tisbo et al. |
| 5,862,688 | A | 1/1999 | Odegard |
| 6,073,470 | A | 6/2000 | Burnitzki |
| 6,105,604 | A | 8/2000 | Furness |
| 6,193,185 | B1 | 2/2001 | Kim |
| 6,299,100 | B1 | 10/2001 | Cloud |
| 6,305,409 | B1 | 10/2001 | Furness |
| 6,318,665 | B1 | 11/2001 | King |
| 6,435,450 | B1 | 8/2002 | Shields et al. |
| 6,978,960 | B2 | 12/2005 | Schaller |
| D513,975 | S | 1/2006 | Falconer |
| 6,997,022 | B1 | 2/2006 | DeMange |
| 7,594,771 | B2 | 9/2009 | Mindler |
| D613,231 | S | 4/2010 | Anderson et al. |
| 7,861,904 | B1 | 1/2011 | Taylor et al. |
| 7,874,511 | B2 | 1/2011 | Chiorgno et al. |
| 8,016,267 | B2 | 9/2011 | Jordan et al. |
| 8,245,965 | B2 | 8/2012 | Andrea et al. |
| 8,403,345 | B2 | 3/2013 | Iossa et al. |
| 8,444,078 | B1 | 5/2013 | Brown et al. |
| 8,602,341 | B2 | 12/2013 | Land |
| 8,616,485 | B2 | 12/2013 | Iossa |
| 8,662,803 | B2 | 3/2014 | Bowman |
| 9,004,392 | B1 | 4/2015 | Bigbee et al. |
| 9,016,607 | B2 | 4/2015 | Wong et al. |
| 9,403,659 | B2 * | 8/2016 | Galindo Gonzalez ..... B65H 75/30 |
| 9,452,908 | B1 | 9/2016 | Bigbee et al. |
| 9,676,587 | B1 | 6/2017 | Bigbee et al. |
| 10,266,366 | B2 * | 4/2019 | Galindo Gonzalez ..... B65H 75/403 |
| 11,358,831 | B2 * | 6/2022 | Gonzalez ..... B65H 75/14 |
| 2007/0114039 | A1 | 5/2007 | Hobdy et al. |
| 2007/0181739 | A1 | 8/2007 | Derendal |
| 2007/0257146 | A1 | 11/2007 | Fleming |
| 2008/0048063 | A1 | 2/2008 | Wells et al. |
| 2009/0272838 | A1 | 11/2009 | Kaminaka |
| 2010/0044490 | A1 | 2/2010 | Fleming et al. |
| 2010/0230528 | A1 | 9/2010 | Singleton |
| 2011/0162916 | A1 | 7/2011 | Salinger et al. |
| 2012/0199683 | A1 | 8/2012 | Cox et al. |
| 2012/0223179 | A1 | 9/2012 | Galindo Gonzalez et al. |
| 2013/0340855 | A1 | 12/2013 | Simpson et al. |

FOREIGN PATENT DOCUMENTS

| | | |
|---|---|---|
| FR | 2572064 | 4/1986 |
| GB | 711140 | 6/1954 |
| GB | 719830 | 12/1954 |
| JP | 60052444 | 3/1985 |
| JP | 5127317 | 5/1993 |
| JP | 2009012933 | 1/2009 |
| WO | WO 03/035529 | 5/2003 |

OTHER PUBLICATIONS

U.S. Office Action dated Aug. 17, 2022 in U.S. Appl. No. 17/208,116.
U.S. Office Action dated Dec. 6, 2022 in U.S. Appl. No. 17/208,116.
U.S. Notice of Allowance dated Feb. 9, 2023 in U.S. Appl. No. 17/208,116.
U.S. Office Action dated Dec. 12, 2023 in U.S. Appl. No. 18/203,507.
Canadian Office Action dated Aug. 18, 2023 issued in Canadian Patent Application No. 2,911,286.
U.S. Office Action dated Aug. 13, 2021 in U.S. Appl. No. 16/390,733.
U.S. Office Action dated Nov. 24, 2021 in U.S. Appl. No. 16/390,733.

(56) References Cited

OTHER PUBLICATIONS

U.S. Notice of Allowance dated Feb. 14, 2022 in U.S. Appl. No. 16/390,733.
Canadian Office Action dated Nov. 6, 2024 issued in Canadian Patent Application No. 2,911,286.
Canadian Office Action dated Feb. 9, 2022 issued in Canadian Patent Application No. 2,911,286.
Australian Examination Report dated Apr. 6, 2021 issued in Australian Patent Application No. 2019201257.
U.S. Notice of Allowance dated Apr. 16, 2012 in U.S. Appl. No. 12/604,883.
U.S. Office Action dated Dec. 12, 2011 in U.S. Appl. No. 12/604,883.
U.S. Office Action dated Dec. 22, 2015 in U.S. Appl. No. 14/198,348.
U.S. Office Action dated Apr. 25, 2016 in U.S. Appl. No. 14/198,348.
U.S. Notice of Allowance dated May 23, 2016 in U.S. Appl. No. 14/198,348.
First Examination Report issued by the Australian Patent Office on Dec. 4, 2017 in Australian Patent Application No. 2015207812.
Second Examination Report issued by the Australian Patent Office on Jul. 27, 2018 in Australian Patent Application No. 2015207812.
U.S. Notice of Allowance dated Feb. 11, 2019 in U.S. Appl. No. 15/225,357.
U.S. Office Action mailed Oct. 26, 2018 in U.S. Appl. No. 15/225,357.
U.S. Office Action dated Feb. 5, 2020 in U.S. Appl. No. 15/678,833.
U.S. Office Action dated Aug. 4, 2020 in U.S. Appl. No. 15/678,833.
Australian Examination Report No. 1 dated Jun. 25, 2020 issued in Australian Patent Application No. 2019201257.
McMaster-Carr Catalog, p. 1166, available at http://www.mcmaster.com/#standard-ball-and-roller-bearings/=r6grse last accessed on Jan. 22, 2014.
Encore Wire Corporation brochure for Reel Payoff® dated 2013, retrieved from http://www.encorewire.com/wp-content/uploads/EncWire-ReelPayoff.pdf on Jul. 16, 2014.
Encore Wire Corporation YouTube.com video for Reel Payoff® uploaded on Feb. 5, 2013 retrieved from http://www.youtube.com/watch?v=Gffwx243ETc on Jul. 16, 2014.
DTS1 Drum Tip Stand retrieved from http://www.sebinternational.com/shop.php?sec=prod&prod=75 on Aug. 11, 2016.
Lever Action Cable Reel Jack retrieved from http://www.wctproducts.com/products/reels/lever-action-reel-jack.php on Aug. 11, 2016.
Cable Reel Trolley retrieved from http://www.brandontoolhire.co.uk/en/moving-and-winching/672-cable-reel-trolley-large.html on Aug. 11, 2016.

* cited by examiner

*Figure 8A*
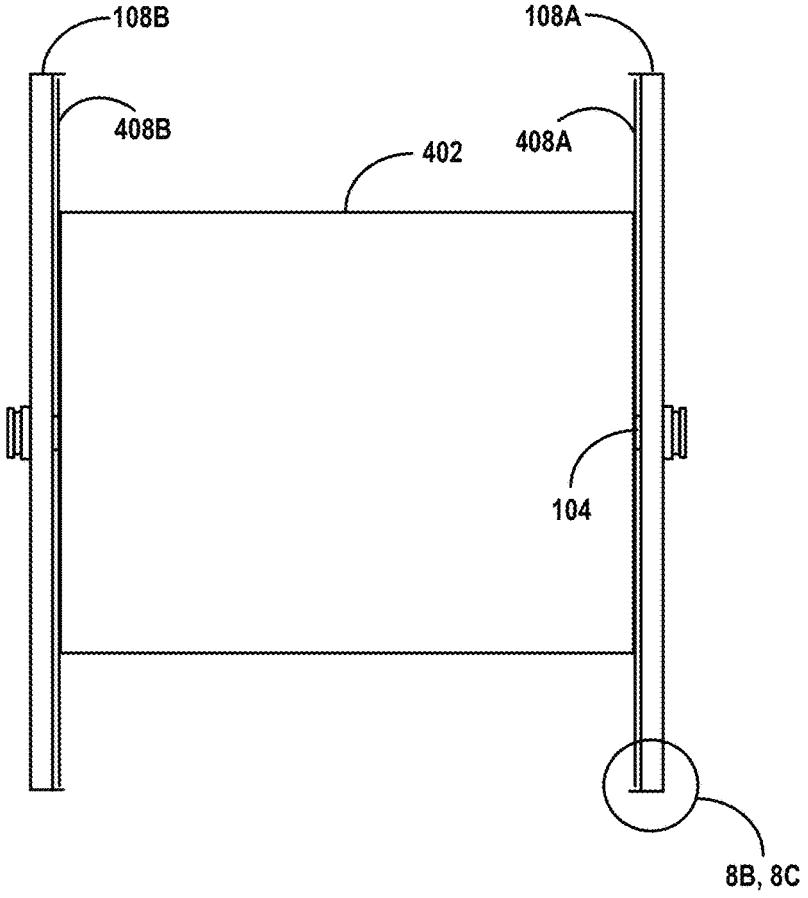
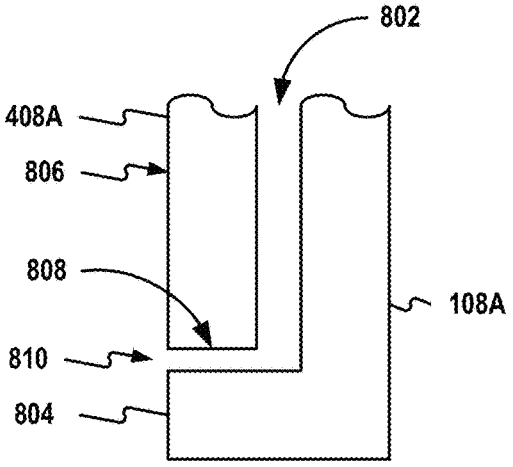
*Figure 8B*
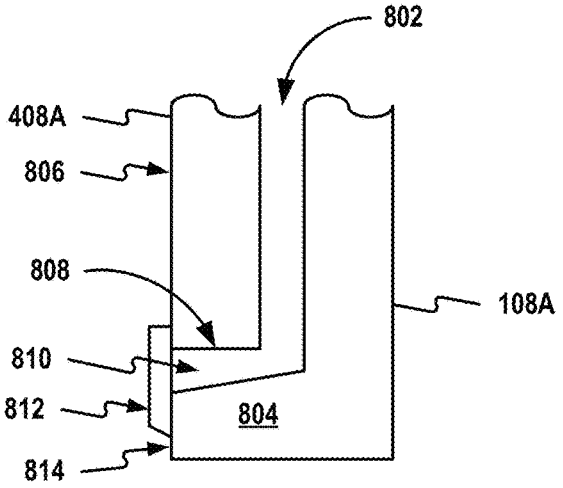
*Figure 8C*

ROTATABLE CABLE REEL

CROSS-REFERENCE TO RELATED APPLICATIONS

This application is a division of and claims priority to U.S. patent application Ser. No. 16/390,733, entitled "Rotatable Cable Reel," filed Apr. 22, 2019, now U.S. Pat. No. 11,358,831, which is expressly incorporated herein by reference in its entirety and which is a continuation of and claims priority to U.S. patent application Ser. No. 15/225,357, entitled "Rotatable Cable Reel," filed Aug. 1, 2016, now U.S. Pat. No. 10,266,366, which is expressly incorporated herein by reference in its entirety and which is a continuation of and claims priority to U.S. patent application Ser. No. 14/198,348, entitled "Rotatable Cable Reel," filed Mar. 5, 2014, now U.S. Pat. No. 9,403,659, which is expressly incorporated herein by reference in its entirety and which claims priority to U.S. Provisional Application No. 61/773,049 filed on Mar. 5, 2013, entitled "Independently Rotatable Cable Reel," which is expressly incorporated herein by reference in its entirety.

BACKGROUND

The present disclosure is directed to cable reels. More particularly, the present disclosure is directed to a cable reel having components with independent rotation about an axis.

Electrical needs of modern facilities such as houses, apartment buildings, warehouses, manufacturing facilities, office buildings, and the like, have increased as the use of electrical devices has increased. During the construction of buildings or the upgrade of electrical/communication systems, cables are typically pulled through a conduit from a source to a destination. For example, a building may be upgraded from copper wires for communication to fiber optic cables. To upgrade, the currently installed cables are typically removed by pulling the cables through a conduit or off of support structures such as cable trays or overhead power lines. Fiber optic cables can be run from a source, such as a cable box outside the building, providing the link to the communication network, such as the Internet, to the building or a structure configured to receive the fiber optic cable.

Because of the length of cable needed in certain installations, the cable is typically wound around a cable reel at an installation facility. The technicians transport the cable reel, which may weigh several tons, from the installation facility in which the cable was wound to the site in which the cable is to be installed. The cable reel is typically lifted from a truck carrying the cable reel to the location in which the cable is to be installed by transport machinery, such as a forklift. In some systems in use today, the cable reel remains loaded on the truck and the cable is pulled from the reel while the reel is on the truck. In other cable installations, because of geographical limitations, the cable reel may need to be moved from the truck to the installation location because the truck cannot be physically located at the installation location. The geographical limitations may also prevent the use of transport machinery, such as a forklift, to transport the cable reel to the installation location. This would require the technicians to manually rotate the cable reel to move it from the truck to the installation location.

Conventional systems may also require the use of labor intensive procedures at the cable winding facility. In the facility, an empty cable reel may need to be moved manually from a storage location to the winding machine. Once wound, the cable reel may need to be manually moved from the winding location to the truck. As mentioned briefly above, a fully wound cable reel can weigh several tons. Even when no cable is wound on a cable reel, if constructed from a material like metal, the cable reel itself can weigh almost a ton. The movement of a cable reel from location to location, whether with cable or empty, can be a labor intensive operation having significant safety concerns. In addition, conventional reels require systems, such as capstans to rotate the conventional reel or otherwise assist in rotating the conventional reel.

It is with respect to these and other considerations that the disclosure made herein is presented.

SUMMARY

The present disclosure is directed to concepts and technologies for a cable reel having components with independent rotation about an axis. A cable reel of the present disclosure can include two flanges and a drum. The drum, which can be configured to receive a length of cable, can be rotatably mounted on an axle. The two flanges can be rotationally mounted on the axle at opposing, distal ends of the axle. The two flanges are rotatably mounted on the axle independent of the drum. In some configurations, this provides for the ability of the drum to rotate about the axle independent of both flanges. In further configurations, the flanges can rotate independently of the drum and of each other.

The cable reel may also be configured with additional features. In one implementation, the width of the cable reel may be adjustable. The flanges may be repositioned along various positions on the axle. The placement of the flanges can increase or decrease the width between the flanges, thus increasing or decreasing the width between the flanges. Although not limited to any particular advantage or feature, providing a cable reel having an adjustable width between the flanges can provide some benefits. For example, it may be beneficial to have a relatively smaller width between the flanges when transporting a cable reel having cable loaded onto it. The relatively smaller width can compress the flanges against the cable, thus reducing the likelihood that the drum will rotate unnecessarily. In a similar manner, during a payoff of the cable, the width between the flanges can be increased to relieve the pressure applied to the cable to reduce the amount of pulling force necessary to payoff the cable. A resistance braking device to control payoff speed may be added. The resistance braking device can act as a drum speed control by providing an opposing force to the rotational force generated by the drum during payoff. The opposing force can help slow down the drum when it is desired to reduce the rate of the payoff of the cable.

In another configuration, adjusting the width between the flanges can be used to accommodate drums of various sizes or to change the number of drums installed on the axle. The drum configuration can be adjusted depending on the particular implementation of the cable reel. For example, the cable reel may be used to install a single cable in one instance, and then, may need to be used to install multiple types of the cables in another instance. In one implementation, the single drum configuration can be modified by removing the single drum, installing the multiple drums to accommodate the multiple types of cables, and adjusting the width between the flanges to complete the reconfiguration.

In another configuration, the drum of the cable reel may be fixable to either flange, or both. In a still further configuration, the cable reel may have one or more shields to protect the cable during the loading or payoff stage. The shielding can act as a barrier between the rotating drum and the fixed flanges during the two stages, reducing wear and tear on the cables. In another implementation, the shield may also reduce the friction between the cable and the flanges. This shield may include a lubricant 401 incorporated in the shield material to reduce the force required to pull the cable against the flanges. The lubricant 401 can be a fluidic or solid lubricant suitable for use in a cable reel. For example, and not by way of limitation, the lubricant 401 can be graphite, oil, or grease. The shield may also include bearings, wheels or other rotatable components that reduce the force necessary to pull the cable against the flanges.

This Summary is provided to introduce a selection of concepts in a simplified form that are further described below in the Detailed Description. This Summary is not intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The accompanying drawings, which are incorporated in and constitute a part of this disclosure, illustrate various embodiments of the present disclosure. In the drawings:

FIG. 8A is a side view of a cable reel, according to exemplary embodiments;

FIGS. 8B and 8C are a detail portions of the cable reel illustrated in FIG. 8A, according to exemplary embodiments;

DESCRIPTION

The following detailed description is directed to concepts and technologies relating to a cable reel having components with independent rotation about an axis. This description provides various components, one or more of which may be included in particular implementations of the systems and apparatuses disclosed herein. In illustrating and describing these various components, however, it is noted that implementations of the embodiments disclosed herein may include any combination of these components, including combinations other than those shown in this description.

Figure 1:
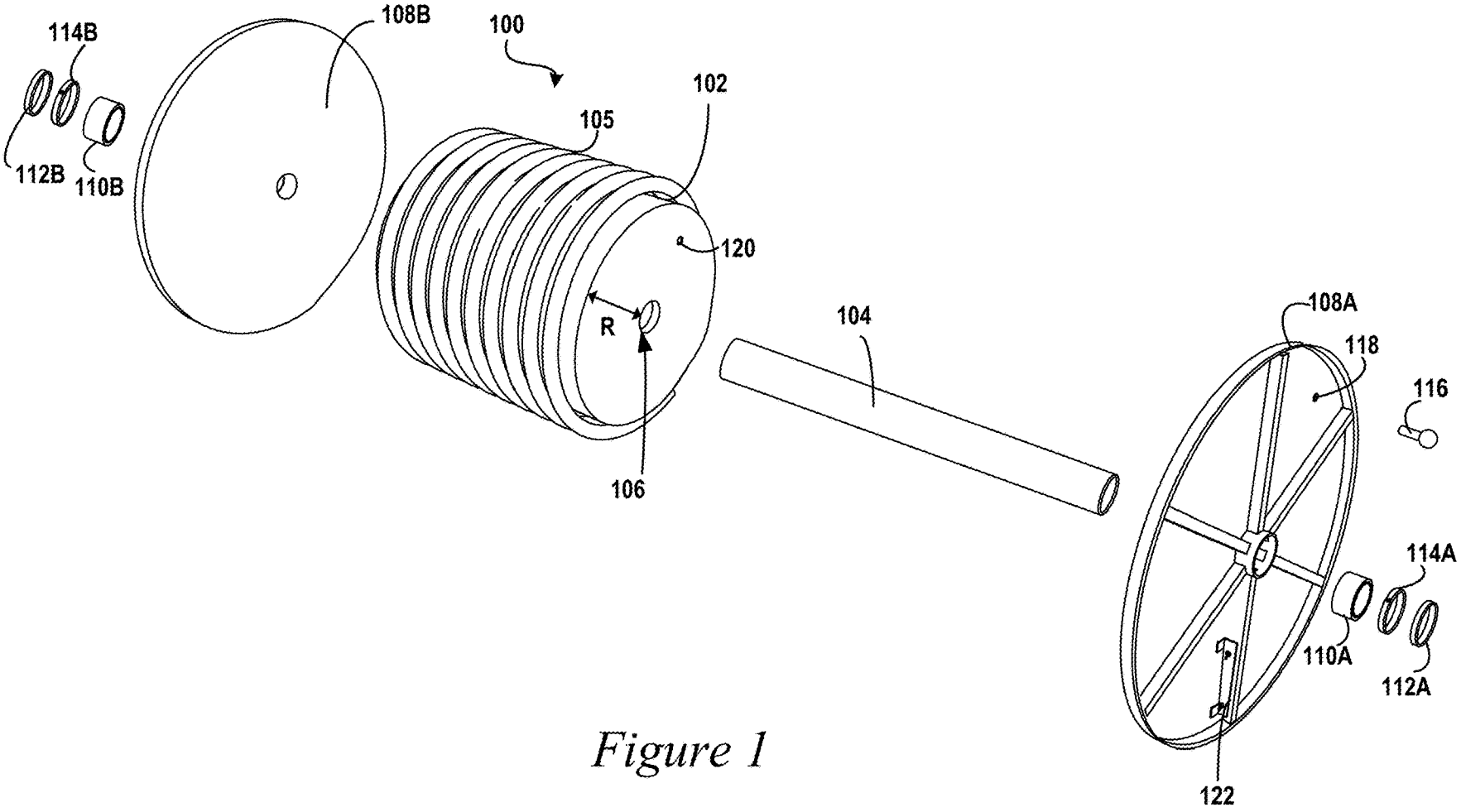
FIG. 1 is an exploded, perspective view of a cable reel, according to exemplary embodiments.

FIG. 1 is an exploded, perspective view of a cable reel 100, according to an exemplary embodiment. In the illustrated embodiment, the cable reel includes a drum 102 that is to be rotationally mounted on an axle 104, described in more detail in FIG. 2 below. In some embodiments, the drum 102 includes a central volume 106 running the length of the drum 102 to receive the axle 104. Although not limited to any particular configuration, the axle 104 may also include an inner void having an inner diameter sufficient to receive a securement mechanism, described in further detail by way of example in FIG. 2. For example, when transporting the cable reel 100, the cable reel 100 may need to be securely affixed to the bed of a truck upon which the cable reel 100 is mounted. In some configurations, a chain or other securement mechanism (not shown) may be inserted through the inner void of the axle 104. The chain may be of sufficient length so that when inserted through the inner void, the ends of the chain can be secured to a securement point on the truck, shown in more detail in FIG. 7, below.

The radius "R" of the drum 102 may vary depending on the particular implementation of the cable reel 100. For example, some installation operations may require a significant amount of cable 105. In order to accommodate the amount of the cable 105 required, or based on the bend radius of the cable 105, the radius R of the drum 102 may be small to allow a large amount of cable 105 to be wound onto the drum 102. In another installation example, the amount of cable 105 may be small when compared to the previous example or, the bend radius of the cable 105 requires the radius of the drum 102 to be larger. However, the concepts and technologies described herein are not limited to any particular radius configuration.

The cable reel 100 also includes flanges 108A and 108B (collectively referred to herein as "the flanges 108"). The flanges 108A and 108B are rotationally mounted onto the axle 104 proximate to the opposing ends of the drum 102. The flanges 108A and 108B include bearings 110A and 110B that are installed at the center of the flanges 108A and 108B, respectively (collectively referred to herein as "the bearings 110"). The bearings 110A and 110B provide for rotational freedom of the flanges 108A and 108B about the axle 104, allowing the flanges 108 to rotate freely with respect to each other, the axle 104 and the drum 102, as described in more detail in FIG. 2 below. In some configurations, the bearings 110 can allow for a full rotation of the flanges 108 about the axle 104. As used herein, "full rotation" means a 360 degree rotation.

A limiting apparatus can be used to limit the movement of the flanges 108A and 108B outwards from the center point of the axle 104. Shown in FIG. 1 are end collars 112A and 112B, mounted onto the axle 104 proximate to the flanges 108A and 108B, respectively (collectively referred to herein as "the end collars 112"). The end collars 112 can be affixed to their respective ends of the axle 104 using various techniques. For example, the end collars 112 can be welded onto their respective ends of the axle 104. In another example, the end collars 112 can be affixed to the end of the axle 104 by screwing the end collars 112 onto a thread of the axle 104.

In some configurations, it may be desirable to limit the physical interaction of the flanges 108 with the end collars 112. In this configuration, the cable reel 100 also includes shaft collars 114A and 114B (collectively referred to herein as "the shaft collars 114"). The shaft collars 114A and 114B can be mounted onto the axle 104 proximate to the flanges 108A and 108B, respectively in such a way that the shaft collars 114 can be adjusted from a first position to a second position along the axle 104. The shaft collars 114 can be mounted to the axle 104 using various techniques, of which the concepts and technologies described herein are not limited to any particular one.

The cable reel 100 can also include a locking pin 116. The locking pin 116 is a pin that is inserted into one of the flanges 108 to lock the rotation of the particular flange with the rotation of the drum, described in more detail in FIG. 2 below. In some implementations, the locking pin 116 can be a rod or other object inserted through an aperture 118 of the flange 108A into an aperture 120 of the drum 102. In this configuration, the independent rotation of the drum 102 is impeded by the pin 116.

The cable reel 100 can further include a chock 122 to limit the rotation of the flange 108A. The chock 122 can be removably affixed to various components of the cable reel 100. In FIG. 1, the chock 122 is shown as being affixed to the flange 108A. If it is desirable or needed to limit the movement of the cable reel 100 along the ground, the chock 122 can be removed from the flange 108A and placed in a suitable location, typically at or near a location of the flange 108A in contact with the ground. Once suitably located, the chock 122 can provide a physical impediment to the rotation of the flange 108A, thus preventing or reducing the amount of movement of the cable reel 100 along the ground. It should be understood that the present disclosure is not limited to the use of the chock 122 as a way to reduce or abate movement of the cable reel 100 along the ground. Other technologies may be used and are considered to be within the scope of the presently disclosed subject matter. Further, it should be appreciated that the movement of the flange 108B may be limited in a similar manner.

Figure 2A:
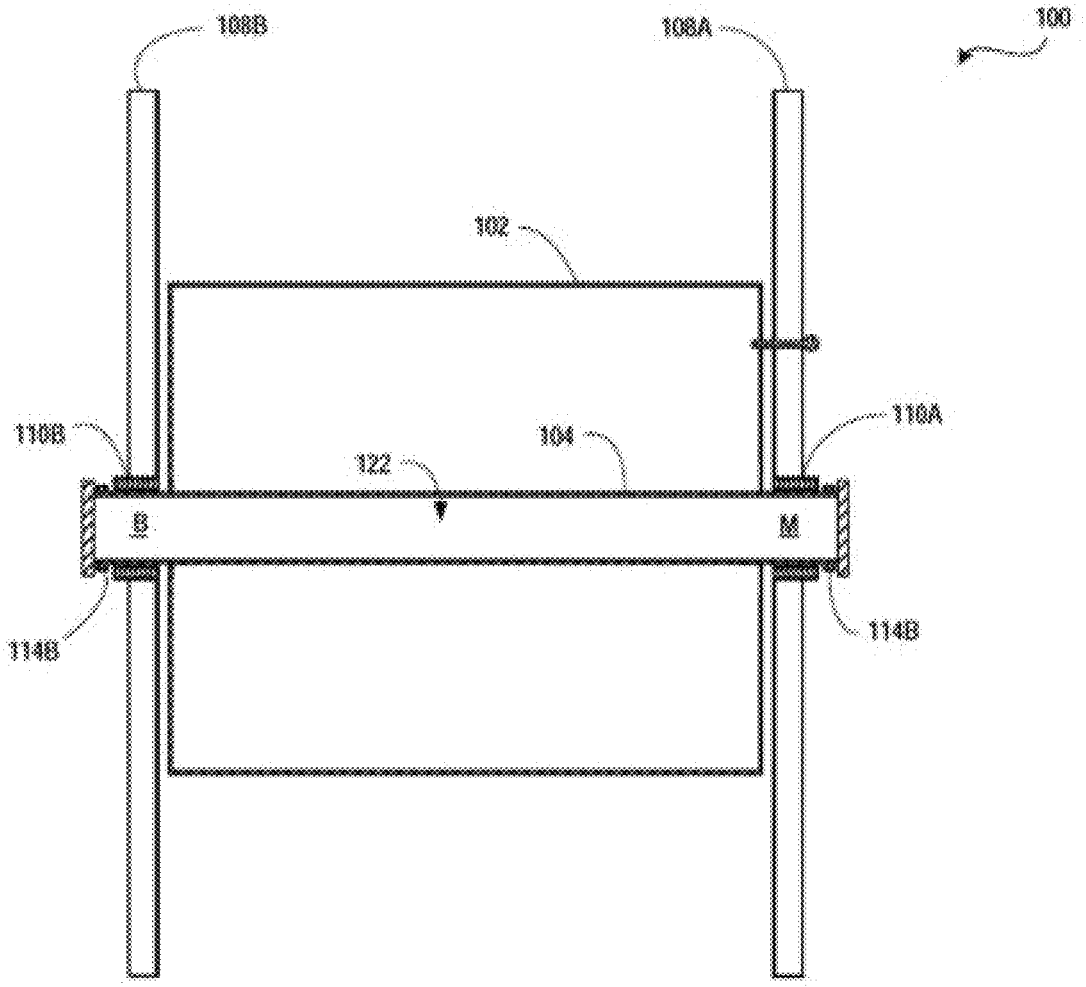
FIG. 2A is a side view of a cable reel, according to exemplary embodiments.

FIG. 2A is a side view of the cable reel 100 in one configuration. As illustrated, the axle 104 is inserted through the central volume 106 of the drum 102. In some conventional cable reels, the drum and the flanges are one integral unit, typically made of wood. The force of pulling the cable from the conventional cable reel imparts a rotational force on the drum, which because of the integral construction, imparts a rotation force on the flanges. In that example, in order to payoff the conventional cable reel, the cable reel would need to be mounted onto an apparatus in such a way as to allow the rotation of the flanges.

FIG. 2A illustrates a way in which a rotational force applied to the drum 102 may not be transferred to the flanges 108. In one configuration, the outer surface of the axle 104 and the inner surface of the central volume 106 are cylindrical in nature, allowing the drum 102 to rotate about the axle 104. In addition, as discussed further below, the flanges 108 are rotatably mounted to the axle 104 by bearings 110 and are not attached or physically connected to the drum 102 when the locking pin 116 is removed from the apertures 118 and 120. This can provide a first degree of rotational freedom for the cable reel 100. In some configurations, this can allow the drum 102 of the cable reel 100 to allow cable to be wound onto or wound off of the drum 102 (paid off) without requiring the rotation of any other portions of the cable reel 100. When installing or removing cable from the cable reel 100, the movement of the cable will cause the drum 102 to rotate about the axle 104 without also rotating the flanges 108. In doing so, in some configurations, there may not be a need for special mounting equipment for the cable reel 100 that helps to facilitate the rotation of the drum 102, since the drum 102 can rotate independently, while allowing the flanges 108 to be rotationally stationary.

Figure 2B:
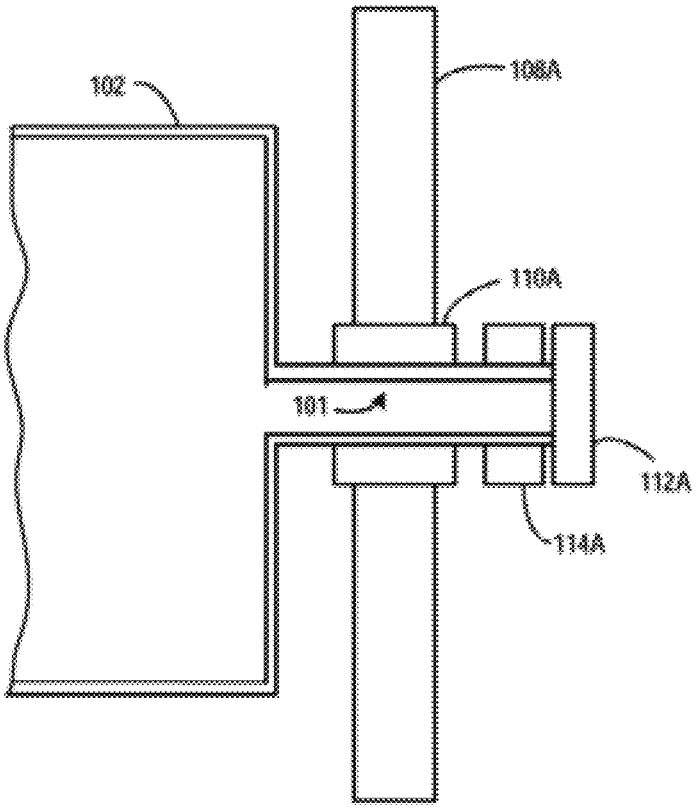
FIG. 2B is a side view of an alternate cable reel without an axle, according to exemplary embodiments.

Although the axle 104 and the drum 102 are illustrated as separate components, the axle 104 and the drum 102 may be combined into an integrated apparatus. For example, as illustrated in FIG. 2B, the drum 102 includes a first end 101. The first end 101 receives the bearing 110A to rotatably mount the drum 102 onto the flange 108A. As illustrated, the drum 102 remains independently rotatable with respect to the flanges 108. In some configurations, the first end 101 of the drum 102 and the flange 108A can be further secured using the end collar 112A and the shaft collar 114A.

Returning to FIG. 2A, as mentioned briefly above, the flanges 108 are mounted onto the axle 104 by bearings 110. The bearing 110A provides for a second degree of rotational freedom for flange 108A and the bearing 110B provides for a third degree of rotational freedom for flange 108B about the axle 104. In particular, the bearings 110A and 110B allow the flanges 108A and 108B to rotate independently of one another as well as the drum 102.

The bearings 110 can be of various types of construction. For example, the bearings 110 can be thrust bearings using ball bearings to facilitate the rotation of the flanges 108 about the axle 104. The bearings 110 can also be, but are not limited to, roller bearings or ball bearings. It should be appreciated that the flanges 108 may be rotationally mounted to the axle 104 without the use of the bearings 110 so as to allow the flanges 108 to rotate about the axle 104. Various embodiments of the present disclosure use bearings to reduce wear and tear on the various parts of the cable reel 100, while also reducing the amount of torque that may be needed to rotate the flanges 108.

Figure 3A:
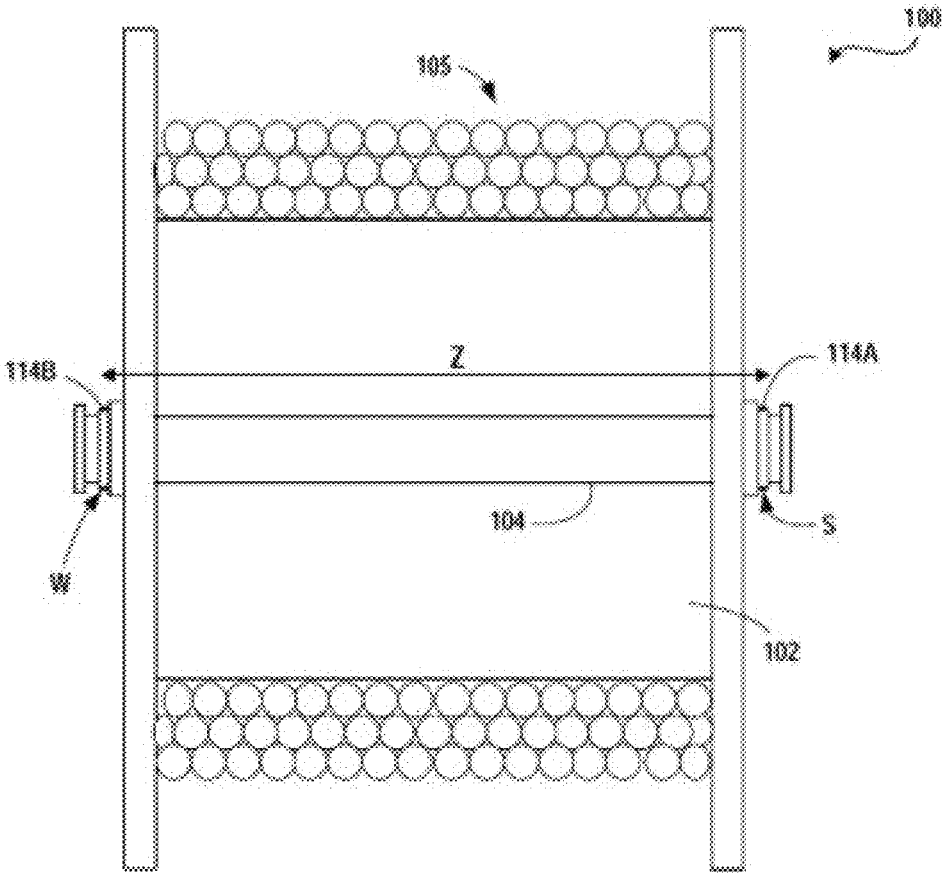
FIGS. 3A-3C are side views showing the adjustment of the width of a cable reel, according to exemplary embodiments.
Figure 3B:
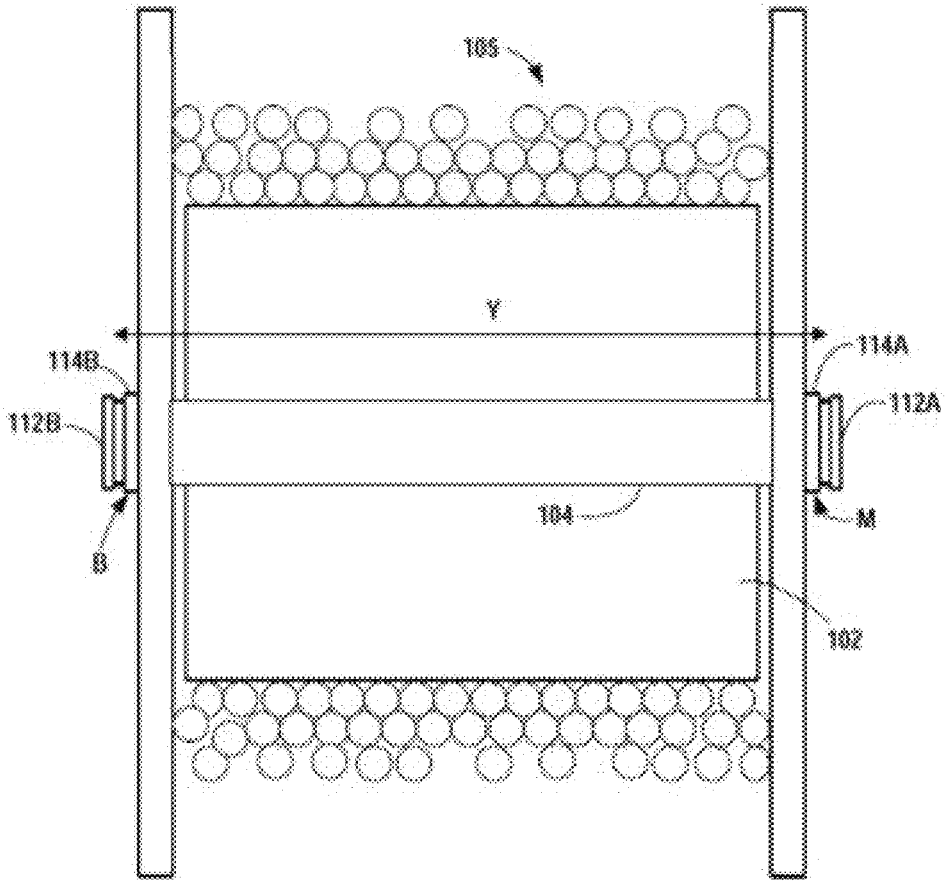
Figure 3C:
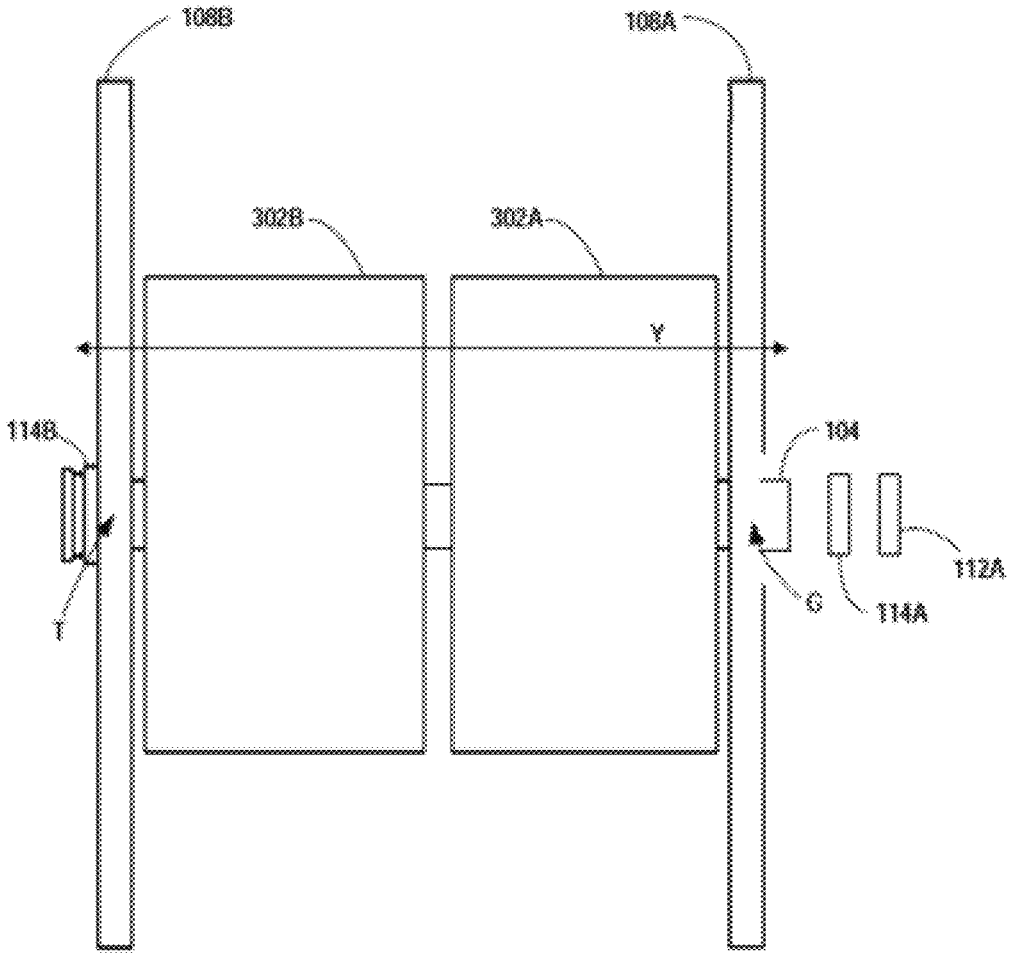

As mentioned briefly above, the required width between the flanges 108 may vary depending on the particular installation or on the particular operation being performed. For example, the cable reel 100 may need to be used with multiple drums, or one drum of one length may need to be switched out to one or more drums of different lengths. In those cases, it may be desired to adjust the width between the flanges 108. In other embodiments, the width between the flanges 108 may need to be increased or decreased to change the pressure and friction between the inner walls of the flanges 108 and a cable wound on the drum 102. In one configuration, the location of the shaft collars 114A and 114B on the axle 104 can be changed to adjust the width between the flanges 108. FIGS. 3A-3C illustrate a way in which the width between the flanges 108 may be adjusted.

FIG. 3A illustrates the shaft collars 114A and 114B at locations "S" and "W" along axle 104 to provide for a width between the flanges 108 of "Z". To facilitate the movement of the shaft collars 114A and 114B from locations "S" and "W", the shaft collars 114A and 114B can be relocated to another position. The concepts and technologies described herein may use various securement technologies to secure the shaft collars 114A and 114B onto the axle 104. For example, the shaft collars 114A and 114B may be bolted onto the axle 104. In another example, the shaft collars 114A and 114B may be pipe clamps that are secured using screws. These and other securement technologies are considered to be within the scope of the presently disclosed subject matter.

Further illustrated is cable 105 wound around the drum 102. When in the configuration of FIG. 3A, the width "Z" causes the cable 105 to be compressed against the inner walls of the flanges 108. As discussed above, while in transport or other similar operation, placing the cable reel 100 in the configuration illustrated in FIG. 3A can help secure the drum 102 by reducing the ability of the drum 102 to rotate due to the pressure imparted onto the cable 105 by the inner walls of the flanges 108. Although this may provide certain benefits in operations in which it is desirable or necessary to compress the cable 105 against the flanges 108, it may be beneficial to reduce the compressive forces by moving the flanges 108 to another position along the axle 104 to provide a relatively larger width between the flanges 108. FIG. 3B illustrates one implementation in which the width between the flanges 108 may be increased.

In FIG. 3B, the shaft collars 114A and 114B have been moved from locations "S" and "W" to locations "M" and B" along with axle 104 to provide for a width of "Y," which is greater than the width "Z" illustrated in FIG. 3A. The larger width of "Y" can increase the space in which the cable 105 can be located. The cable 105 is shown in FIG. 3B as being decompressed when compared to the cable 105 when in the configuration illustrated in FIG. 3A. The decompression of the cable 105 can reduce the amount of contact and the amount of pressure between the cable 105 and the flanges 108. This can reduce the amount of pulling force necessary to payoff the cable 105.

As mentioned above, moving the shaft collars 114A and 114B from the width "Z" between the flanges 108, as illustrated in FIG. 3A, to a larger width, such as the width "Y" illustrated in FIG. 3B, can also allow for a change from one drum of one length to a drum of another length or from one drum to several drums. FIG. 3C illustrates a cable reel 100 configured to handle several drums. In FIG. 3C, the flanges 108A and 108B are placed at locations "G" and "T," respectively, along the axle 104 to provide for the width of "Y" between the flanges 108. The second width of "Y" can allow the drum 102 of FIG. 2 to be replaced with drums 302A and 302B.

As illustrated in FIG. 3C, the end collar 112A and the shaft collar 114A have been removed from the axle 104. The removal of the end collar 112A and the shaft collar 114A from the axle 104 can allow the drum 102 to be removed from the cable reel 100 along the length of the axle 104. Subsequently, another drum, such as the drums 302A and 302B, may then be installed on the axle 104. To secure the drums 302A and 302B onto the cable reel 100, the end collar 112A and the shaft collar 114A can be reinstalled in the configuration illustrated by way of example in FIG. 3B.

The ability to modify the configuration of the cable reel 100 from one drum to multiple drums may provide benefits in various situations. For example, the cable reel 100 may be used to install a single type of cable in one installation and, in a subsequent installation, be used to install multiple types of cables. Instead of using multiple cable reels, the cable reel 100 can be reconfigured from handling a single type of cable, using the drum 102, to handling multiple types of cable on multiple drums, using the drums 302A and 302B.

When winding the cable 105 onto or paying off the cable 105 from the cable reel 100, the cable 105 may come in contact with the flanges 108. While the cable 105 is stationary on the drum 102, the cable 105 may be in a state in which damage may not be imparted onto the cable 105. But, if the drum 102 is being rotated, either during a windup or payoff operation, the portion of the cable 105 closest to the flanges 108 may rub against or otherwise come in frictional contact with the flanges 108. If the cable 105 is a sturdy cable that can handle the frictional contact, any frictional effects on the cable 105 may be minimal. But, in some implementations, the frictional contact may damage or deform the cable 105, reducing the integrity of the cable 105. This can be especially troublesome for cable installed below ground, where access to the cable 105 is likely impeded by either the ground or a structure such as a building.

Figure 4A:
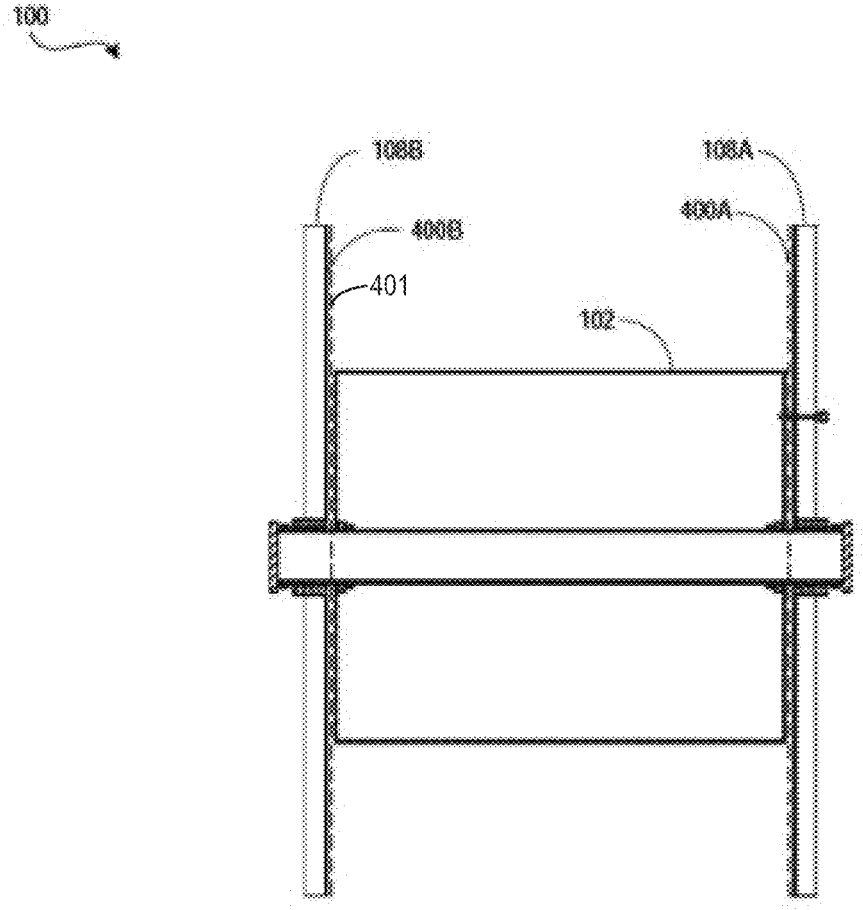
FIG. 4A is a side view of a cable reel in which a shield is used to reduce the coefficient of friction between the cables and the cable reel, according to exemplary embodiments.

FIG. 4A is an illustration showing the cable reel 100 in a configuration that can reduce the frictional impact on the cable 105. Shown installed on the cable reel 100 are the drum 102 and the flanges 108. As mentioned above, if the drum 102 is rotated relative to the flanges 108, the cable 105 proximate to the flanges may rub against or otherwise come in moving contact with the surface of the flanges 108. The pressure, heat and abrasion that can occur may cause the cable 105 to be damaged or deformed. This can be especially true if the coefficient of friction between the cable 105 and the flanges 108 is relatively high.

To reduce the coefficient of friction, a material having a lower coefficient of friction may be installed as a barrier between the cable 105 and the flanges 108. Illustrated in FIG. 4A is a shield 400A and 400B (collectively referred to herein as "the shields 400") installed proximate to the flanges 108A and 108B, respectively, between the cable 105 and the flanges 108A and 108B. The shields can be a material that reduces the coefficient of friction applied to the cables. In some implementations, the material can be constructed of a polymeric material such as polyvinyl chloride (PVC) or polytetrafluoroethylene (TEFLON). In some implementations, the PVC or TEFLON can act as a barrier to reduce the frictional impact on the cable, while the flanges 108 are used to support the weight of the cable reel. As it should be appreciated, other materials, including non-polymers or plastic, may be used and are considered to be within the scope of the present disclosure.

Figure 4B:
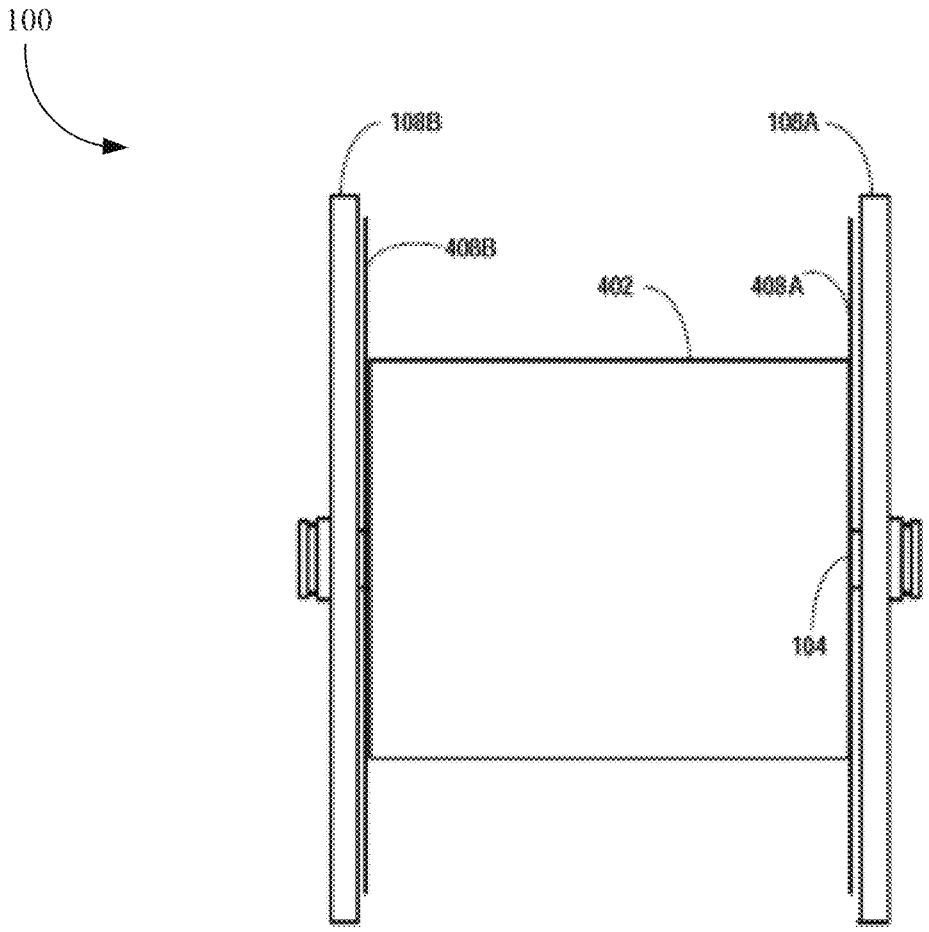
FIG. 4B is a side view of a cable reel showing an alternate shield configuration, according to exemplary embodiments.

FIG. 4B is an alternate shield configuration for the cable reel 100. Illustrated in FIG. 4B are flanges 108 rotatably mounted onto the axle 104. Rotatably mounted onto the axle 104 is the drum 402. As discussed above in regard to FIG.

4A, when a drum, such as the drum 402, is rotated about the axle 104 while the flanges 108 remain stationary, cable on the drum 402 can come in contact with the flanges 108. To reduce or eliminate the impact caused by the rotation of the drum 402, the drum 402 has drum flanges 408A and 408B. In one implementation, the drum flanges 408A and 408B are fixedly mounted onto the drum 402. In this implementation, when the drum 402 is rotated about the axle 104, the drum flanges 408A and 408B also rotate at the same speed and in the same direction as the drum 402. Thus, during installation or during payoff, damage or deformation that may be caused by frictional forces may be reduced. It should be appreciated that the drum flanges 408A and 408B and the drum 402 may be one unit or may be an integrated apparatus.

Figure 5:
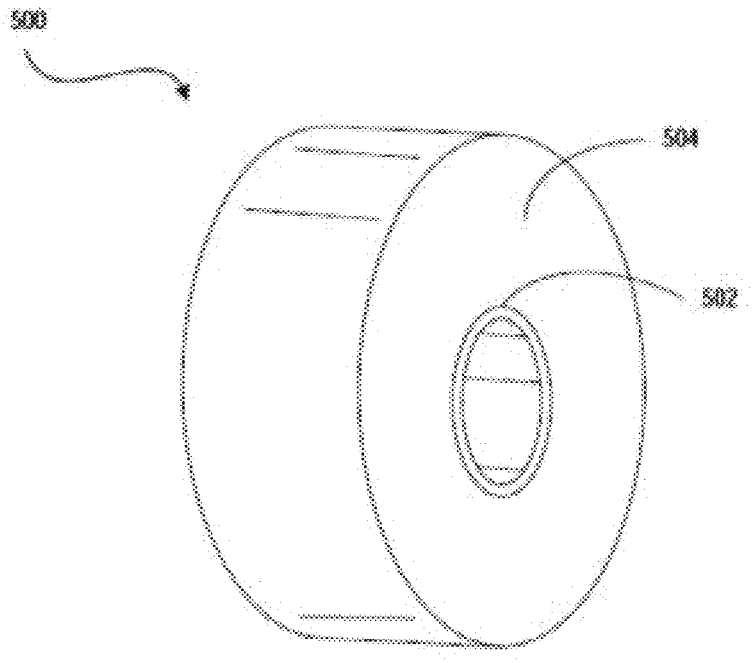
FIG. 5 is perspective view of an exemplary bearing structure, according to exemplary embodiments.

FIG. 5 is an illustrative bearing 500 that may be used for the bearings 110A and 110B, illustrated by way of example in FIG. 1. The bearing 500 may include a flange bearing 502 with an inner surface disposed proximate to and in contact with the outer surface of an axle, such as the axle 104 of FIG. 1. In some implementations, the contact may be secured based on the physical dimensions of the flange bearing 502 and the axle 104. For example, the inner diameter of the flange bearing 502 may be just large enough to allow placement of the bearing 500 over the surface of the axle 104.

In some configurations, the inner diameter of the flange bearing 502 may be so close to the outer diameter of the axle 104 that special means may be used to install the flange bearing 502 on the axle 104. For example, the flange bearing 502 may be heated to cause the flange bearing to expand, thus allowing the flange bearing 502 to be placed onto the axle 104. In the alternative, the axle 104 may be cooled to cause the axle 104 to contract. In some implementations, the flange bearing 502 may be forced onto the axle by means of a striking motion, such as from a hammer or other tool. In other configurations, the flange bearing 502 may be fixedly installed onto the axle 104 using adhesives or welding. The concepts and technologies described herein are not limited to any particular manner in which the flange bearings 502 are installed onto the axle.

In a similar manner, a flange bearing spacer 504 may be installed on the flange bearing 502. In some configurations, the flanges, such as the flanges 108, may not have an inner diameter close to the outer diameter of the flange bearings 502. In this configuration, the flange bearing spacer 504 may be installed between the inner surface of the flanges 108 to which the flange bearings 502 are to be installed and the flange bearings 502 themselves. It should be appreciated that the disclosure provided herein is not limited to the type of bearing described as the flange bearings 502 or the need to include the flange bearing spacer 504.

Figure 6:
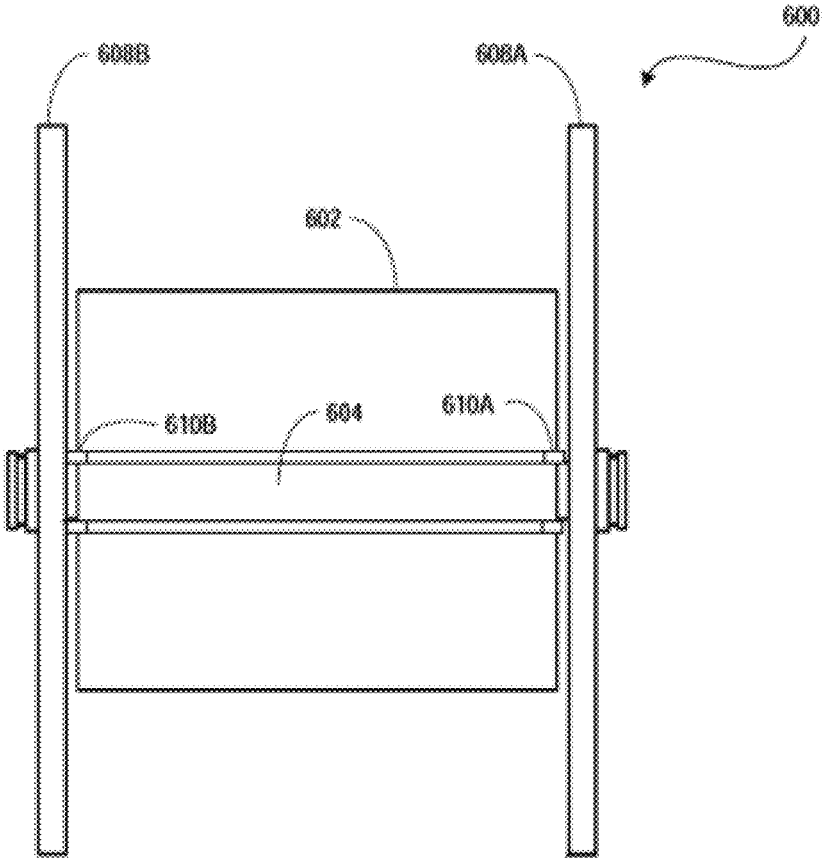
FIG. 6 is a side view of an alternate bearing structure used in a cable reel, according to exemplary embodiments.

FIG. 6 is a side view of a cable reel 600 using an alternative bearing arrangement. Illustrated in FIG. 6 are flanges 608A and 608B installed on an axle 604. The cable reel 600 also includes a drum 602 rotatably mounted onto the axle 604. The rotational motion of the drum 602 about the axle 604 is provided by bearings 610A and 610B (collectively referred to herein as "the bearings 610"). The bearings 610 are disposed in the drum 602 rather than in the flanges 608A and 608B, illustrated by way of example in FIG. 1, above. Specifically, in FIG. 1, the bearings 110 are vertically supported by the flanges 108, whereas in FIG. 6, the bearings 610 are vertically supported by the drum 602. This configuration may provide for various benefits. For example, the bearings 610 of FIG. 6 are disposed within the cable reel 600, whereas the bearings 110 of FIG. 1 are disposed in the flanges 108. This may help to protect the bearings 610 from damage caused by outside forces.

Figure 7:
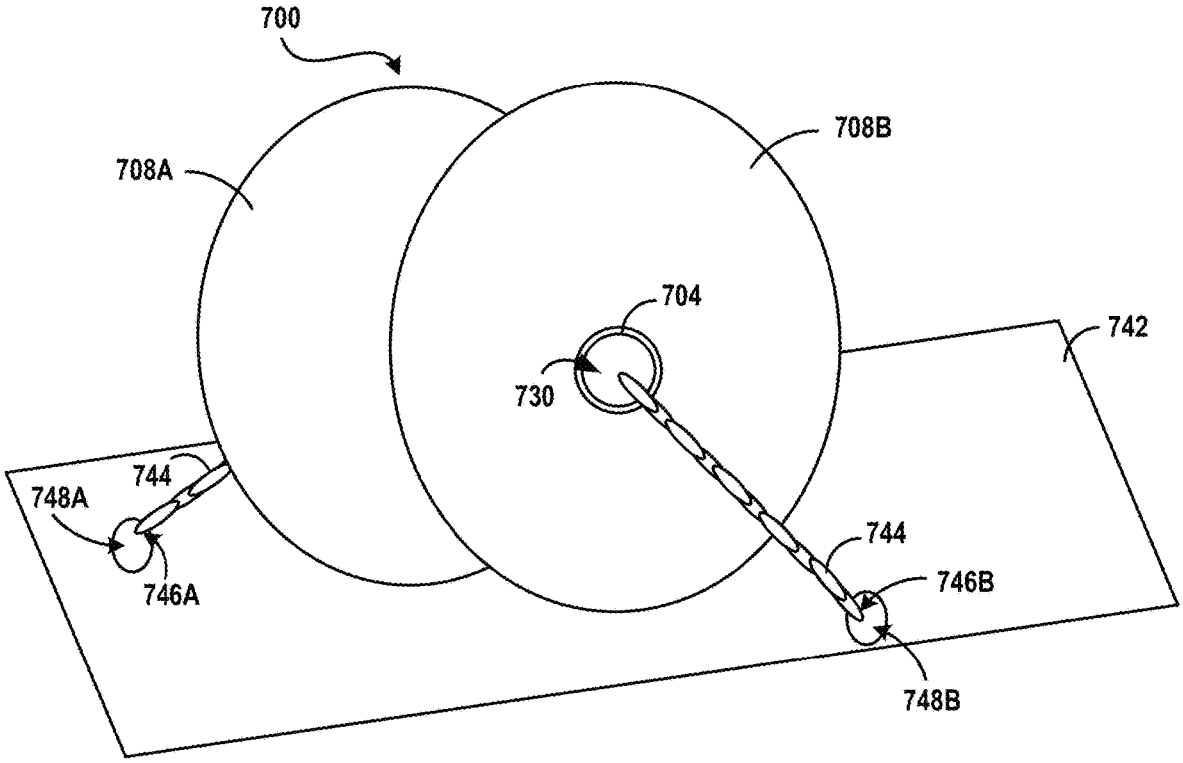
FIG. 7 is an illustration showing the securement of a cable reel onto a truck, according to exemplary embodiments.

FIG. 7 is an illustration showing the transportation of a cable reel 700 on a flatbed 742 of a truck (not illustrated). As illustrated, a cable reel 700 includes flanges 708A and 708B rotatably mounted onto an axle 704 having an inner void 730. During transport, it may be desirable or required to secure the cable reel 700 to the flatbed 742. In one configuration, the cable reel 700 axle 704 has an inner aperture 730 running the length of the axle 704. The inner aperture 730 may be large enough to allow a chain 744 to be installed through the inner aperture 730. In some implementations, the chain 744 has a length to allow for the chain 744 to be installed through the axle 704 and have its ends 746A and 746B secured to securement points 748A and 748B of the flatbed 742. In this implementation, by securing the cable reel 700 to the flatbed 742 using the chain 744, the cable reel 700 may be transported from one location to the next in a safe and legal manner.

FIGS. 8A-8C show further configurations for the cable reel 100, according to an exemplary embodiment. Illustrated in FIG. 8A are the flanges 108 rotatably mounted onto opposing, distal ends of the axle 104. As discussed above, a drum, such as the drum 402, may be rotatably mounted onto the axle 104 such that the drum rotates independent of the axle as illustrated in FIG. 2A, or the drum may be fixedly mounted to the axle such that the drum rotates along with the axle as the axle rotates as illustrated in FIG. 2B. As discussed above in regard to FIG. 4A, when a drum, such as the drum 402, is rotated, whether that rotation is independent of the axle 104 or along with the axle, while the flanges 108 remain stationary, cable on the drum 402 can come in contact with the flanges 108. To reduce or eliminate the impact caused by the rotation of the drum 402, the drum 402 has drum flanges 408A and 408B. Consistent with embodiments, the drum flanges 408A and 408B are fixedly mounted onto the drum 402. In this embodiment, when the drum 402 is rotated, according to some embodiments independently of the axle 104 or according to other embodiments along with the axle 104, the drum flanges 408A and 408B also rotate at the same speed and in the same direction as the drum 402. Thus, during installation or during payoff, damage or deformation that may be caused by frictional forces may be reduced. In addition, when the flanges 108 are rotated (e.g., during transport of the cable reel 100), the drum 402 may not rotate or rotate very little since the flanges 108 and the drum rotate independently of one another. The lack of rotation the drum 402 exhibits when the flanges 108 are rotated may ease transportation due to a lack of rotational inertia exhibited by the drum 402. In other words, moving the cable reel 100 may be easier because when a user tries to stop the cable reel 100, rotational inertia of the drum 402 will not be as great, and the user will only need to break the linear inertia exhibited by the drum as opposed to both the linear inertia and the rotational inertia. It should be appreciated that the drum flanges 408A and 408B and the drum 402 may be one unit or may be an integrated apparatus.

In addition, to reduce friction and possible binding between the flanges 108 and the drum flanges 408A and 408B, a first space 802 (shown in FIG. 8B) may be created between the flange 108A and the drum flange 408A as well as between the flange 108B and the drum flange 408B. Although only the configuration of the flange 108A, the drum flange 408A, and the first space 802 is illustrated in FIGS. 8B and 8C and discussed below, it should be understood that the configuration of the flange 108B, the drum flange 408B, and the first space 802 of the cable reel 100 is the same, according to an exemplary embodiment. The first space 802 may be sized to reduce the need for grease or other lubricants between the flanges 108 and the drum flanges 408A and 408B. In addition, the first space 802 may be sized to prohibit insertion of a thumb, finger, or other limb of a user between the flange 108A and the drum flange 408A. However, the first space 802 may collect dirt and other debris during use. To help minimize dirt and debris accumulation within the first space 802, the flanges 108 may include a lip 804 as shown in FIG. 8B. The lip 804 may be a separate piece of material that is attached to the flanges 108 and can be removed. Having the lip 804 be removable may assist in replacing the lip 804 due to excessive wear. In addition, removing the lip 804 may assist in regular maintenance by allowing service personal to access the first space 802 for cleaning and lubricating without having to disassemble the cable reel 100 or completely remove the flanges 108. Accordingly to further embodiments, the flanges 108 and the lip 804 may be one unit.

As shown in FIG. 8B, the lip 804 may extend from the flange 108A and be flush with a side 806 of the drum flange 408A. Consistent with embodiments, the lip 804 may extend past an edge 808 of the flange 108A and thus past the side 806 of the drum flange 408A, or the lip 804 may extend only partially across the edge 808 of the drum flange 408A. The extension of the lip 804 may create a second space 810 between the lip 804 and the edge 808 of the drum flange 408A. The second space 810 may be sized to be large enough to reduce the need for grease or other lubricants between the flanges 108 and drum flanges 408. However, the second space 810 may also be small enough such that debris and other materials that may increase friction between the drum flanges 408 and the flanges 108 cannot easily enter and collect within the second space 810. In addition, the second space 810 may be sized to prohibit insertion of a thumb, finger, or other limb of a user between the flange 108A and the edge 808 of the drum flange 408A. For example, the second space 810 may be large enough not to cause binding, yet small enough to prevent small rocks, wood chips, other construction type debris, or limbs of users from entering or getting stuck. For example, in various embodiments, the second space 810 may provide for ¼ of an inch clearance between the flange 108A and the drum flange 408A. Furthermore, as shown in FIG. 8C, the lip 804 may include an angled surface 812 to help minimize debris collecting within the second space 810.

As shown in FIG. 8C, a protective cover 812 may be attached to either the flange 108A or the drum flange 408A to provide a physical barrier to hinder debris from entering the second space 810. The protective cover 812 may be a plastic, metallic, or ceramic material. If the protective cover 812 is attached to the flange 108A (e.g., at a side 814 of the lip 804), a portion of the protective cover 812 overlapping the drum flange 408A may rest against a portion of the side 806 of the drum flange 408A or may overlap the portion of the side 806 of the drum flange 408A and be positioned proximate the portion of the side 806 of the drum flange 408A without resting against the portion of the side 806 of the drum flange 408A. If the protective cover 812 is attached to the drum flange 408A (e.g., at the side 806 of the drum flange 408A), a portion of the protective cover 812 overlapping the lip 804 may rest against a portion of the side 814 of the lip 804 or may overlap the portion of the side 814 of the lip 804 and be positioned proximate the portion of the side 814 of the lip 804 without resting against the portion of the side 814 of the lip 804.

The first space 802 and the second space 810 may create equal spacing between the drum flange 408A and the flange 108A, or the spacings created by the first space 802 and the second space 810 may be different. According to exemplary embodiments, for instance, the first space 802 may provide for a distance of ½ of an inch between the drum flange 408A and the flange 108A, and the second space 810 may provide for a distance of ¼ of an inch between the drum flange 408A and the flange 108A.

Figure 9:
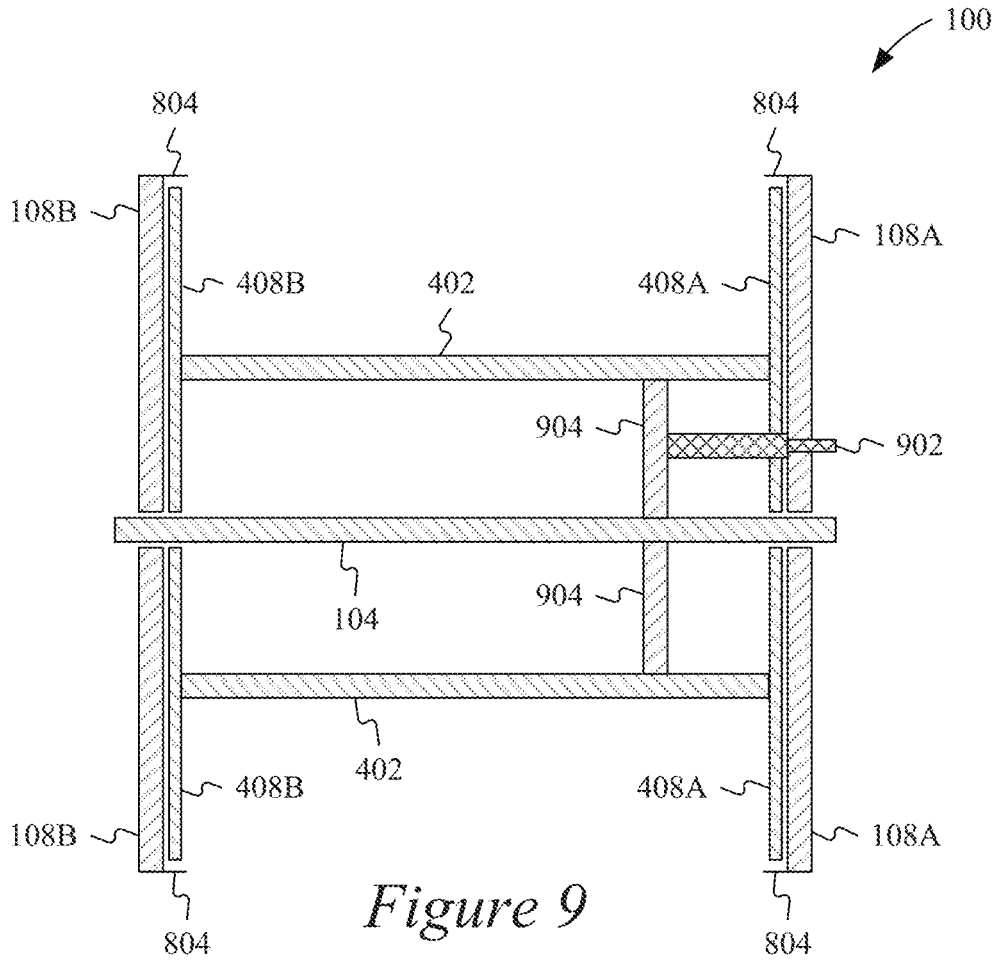
FIG. 9 shows a side view of a cable reel comprising an over-spin control, according to exemplary embodiments.

FIG. 9 shows a further configuration of the cable reel 100, according to an exemplary embodiment. As shown in FIG. 9, the cable reel 100 includes an over-spin control 902 and a brake disc 904. As illustrated in FIG. 9, the flanges 108 are rotatably mounted onto the axle 104. As discussed above, a drum, such as the drum 402, may be rotatably mounted onto the axle 104 such that the drum 402 rotates independent of the axle 104 as illustrated in FIG. 2A, or the drum 402 may be fixedly mounted to the axle 104 such that the drum 402 rotates along with the axle 104 as the axle 104 rotates, as illustrated in FIG. 2B. As discussed above in regard to FIG. 4A, the flanges 108 of the cable reel 100 remain stationary while the drum 402 rotates, whether the rotation of the drum 402 is independent of the axle 104 or along with the axle 104. However, at times, such as when cable, like the cable 105, is loaded on the drum 402, it may be desirable to have the drum 402 locked to at least one of the flanges 108 (e.g., the flange 108A as shown in FIG. 9). The over-spin control 902 in conjunction with the brake disc 904 may be used to lock the flange 108A and the drum 402 together to hinder separate rotation of the flanges 108 and the drum 402. In addition, the over-spin control 902 may provide resistance such that the flanges 108 rotate independent of the drum 402, but with a back tension to prevent excess slack from developing within a cable, such as the cable 105, when the cable 105 is being paid off the cable reel 100.

Figure 10:
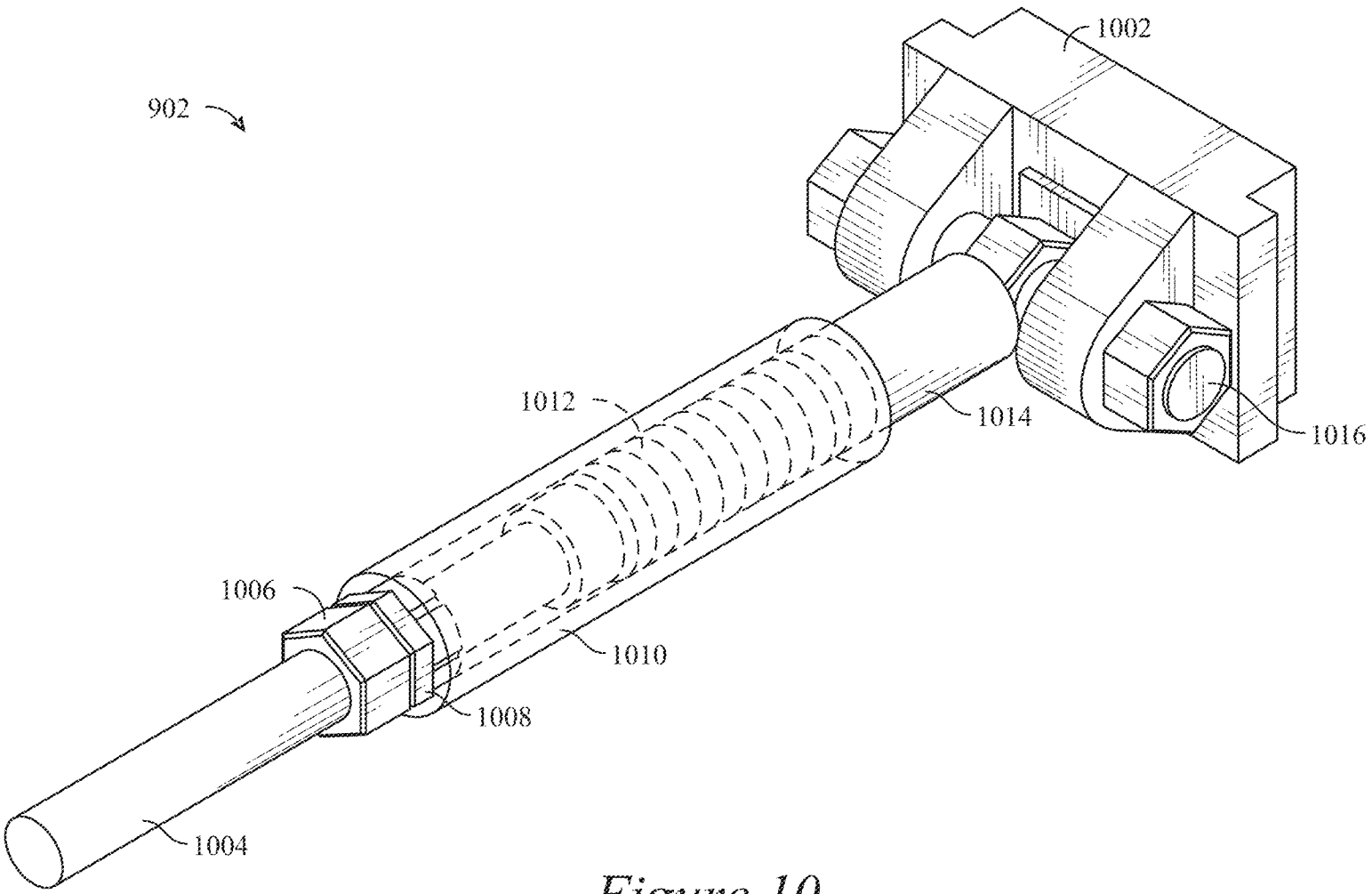
FIG. 10 shows an over-spin control, according to exemplary embodiments.

FIG. 10 illustrates further details of the over-spin control 902 of FIG. 9, according to an exemplary embodiment. The over-spin control 902 includes a brake pad 1002, a threaded shaft 1004, a locking nut 1006, a fixed nut 1008, an over-spin control body 1010, a spring 1012, and a piston 1014. The piston 1014 may be connected to the brake pad 1002 via a bolt 1016. As shown in FIG. 9, the over-spin control 902 is located, at least partially, within the drum 402. The over-spin control 902 may be connected to the flange 108A. For example, the threaded shaft 1004 may protrude through the flange 108A, and a portion of the flange 108A may be sandwiched between the over-spin control body 1010 and the fixed nut 1008. To secure the over-spin control 902 in a desired position, the user may cinch the locking nut 1006 to the fixed nut 1008 to prevent rotation of the threaded shaft 1004. Still consistent with embodiments, the portion of the flange 108A may be sandwiched between the fixed nut 1008 and the locking nut 1006. In this instance, friction between the threaded shaft 1004 and the fixed nut 1008 and the locking nut 1006 may be sufficient to secure the over-spin control 902.

During use of the cable reel 100, the flanges 108 may rotate freely of the drum 402. To engage the over-spin control 902 and sync rotation of the flanges 108 and the drum 402, or increase the back tension and allow the flanges 108 to continue to rotate independently of the drum 402, a user may rotate the threaded shaft 1004 in a first direction. Rotation of the threaded shaft 1004 in the first direction causes the threaded shaft 1004 to apply a force to the spring 1012, which in turn applies a force to the piston 1014, which in turn presses the brake pad 1002 against the brake disc 904 resulting in an increased coefficient of static friction. To rotate the threaded shaft 1004, the user may use a wrench or a knob (not shown) attached to the end of the threaded shaft 1004.

To release the pressure exerted by the brake pad 1002 on the brake disc 904, and thus decrease the back tension, the threaded shaft 1004 may be rotated in a second direction. Rotation of the threaded shaft 1004 in the second direction causes the force applied to the spring 1012 by the threaded shaft 1004 to decrease, which in turn causes the force applied to the piston 1014 by the spring 1012 to decrease, which in turn causes the force applied by the piston 1014 to the brake pad 1002 to decrease resulting in a decreased coefficient of static friction. Consistent with the embodiments, the threaded shaft 1004 may be connected directly to the piston 1014 or the brake pad 1002. Still consistent with embodiments, the spring 1012 may be connected directly to the brake pad 1002.

Figure 11A:
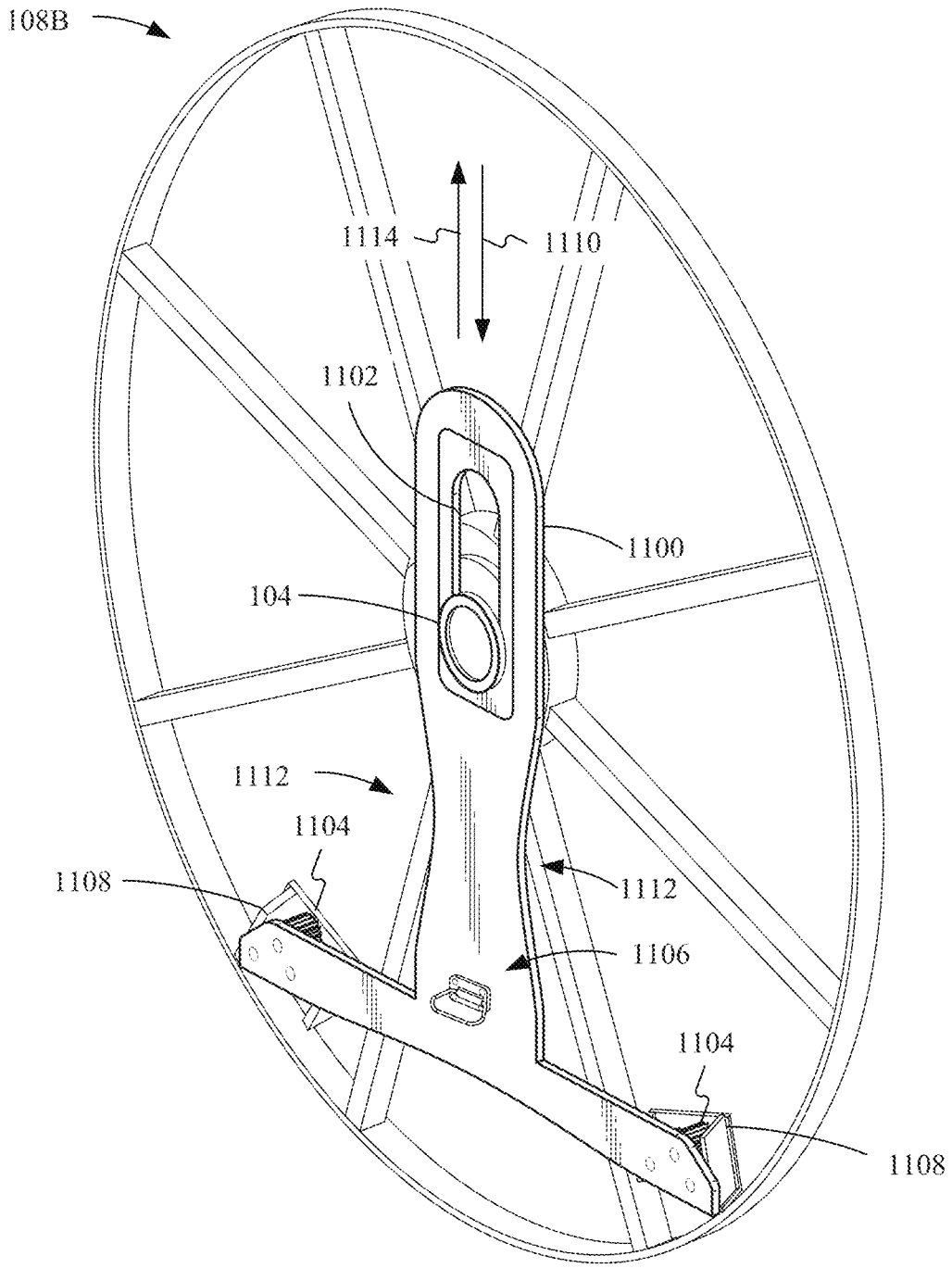
FIGS. 11A and 11B show a scotch, according to exemplary embodiments.
Figure 11B:
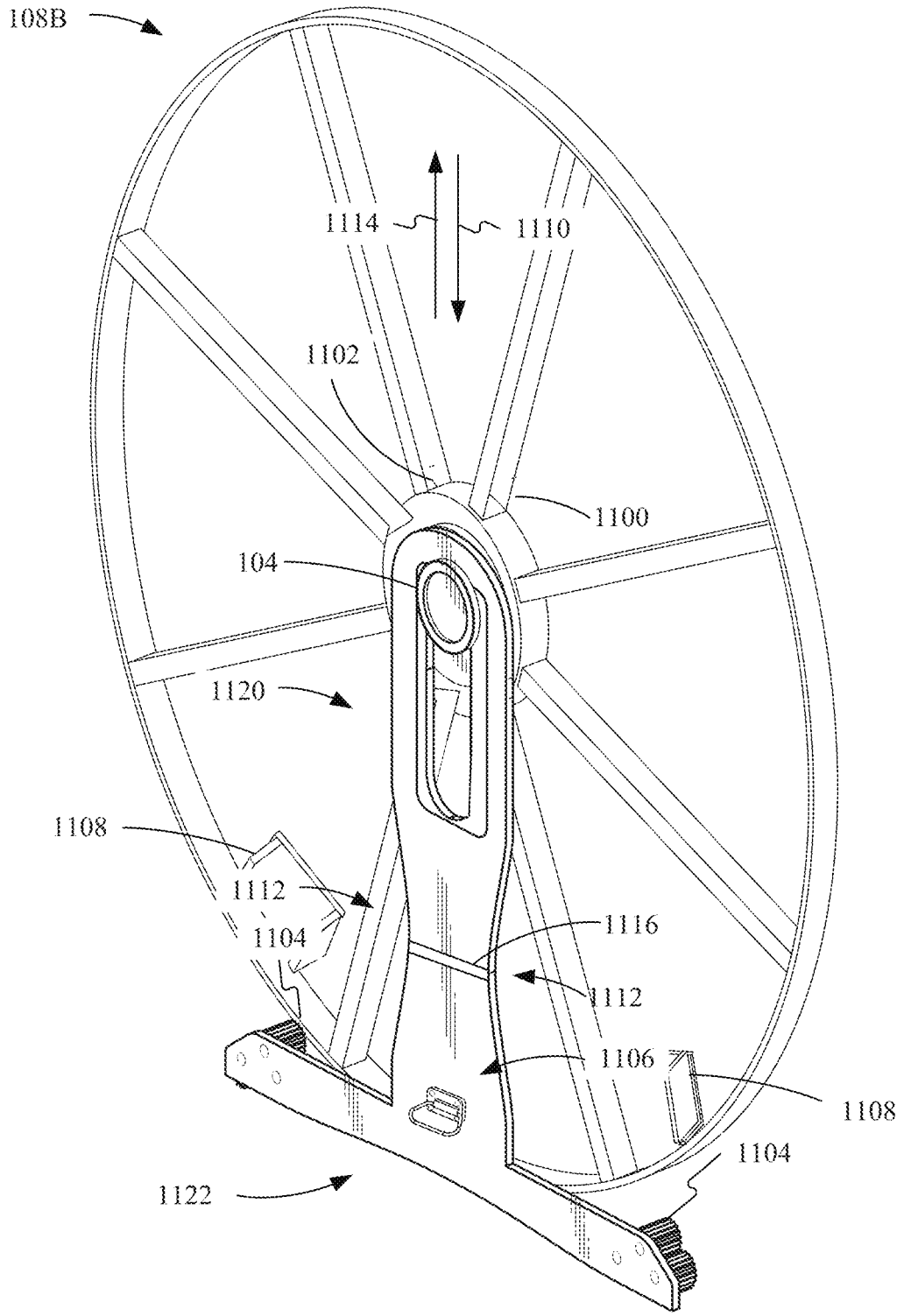

FIGS. 11A and 11B show a scotch 1100, according to an exemplary embodiment. The scotch 1100 may be used to hinder rotation of the flanges 108. For clarity purposes only, the flange 108B is shown, but the scotch 1100 may be located on the flange 108A, the flange 108B, or both of the flanges 108.

The scotch 1100 may be connected to the axle 104. The scotch 1100 may include an opening 1102 that allows the scotch 1100 to traverse the axle 104 in a first direction, indicated by an arrow 1110, perpendicular to an axis of the axle 104 and in a second direction, indicated by an arrow 1114, perpendicular to the axis of the axle 104 and opposite the first direction. In addition, the scotch 1100 may include stoppers 1104 and a handle 1106. The stoppers 1104 may protrude into pockets 1108 as shown in FIG. 11A or other recesses (not shown) in the flange 108B.

While the cable reel 100 is being rotated, the stoppers 1104 may rest in the pockets 1108 attached to the flange 108B, as shown in FIG. 11A. Once the cable reel 100 is in a desired location, a user may pull the handle 1106, which may cause the scotch 1100 to flex. The flexing motion allows the stoppers 1104 to clear the pockets 1108. Once the stoppers 1104 have cleared the pockets 1108, the scotch 1100 may traverse in the first direction (as indicated by the arrow 1110) until the stoppers 1104 clear the edge of the flange 108B. As shown in FIG. 11B, after the stoppers 1104 have cleared the edge of the flange 108B, the scotch 1100 may return to an unflexed state and the stoppers 1104 may rest between the edge of the flanges 108B and a surface (not shown) supporting the cable reel 100 and provide an obstacle to prevent the flange 108B from rotating. The stoppers 1104 may be returned to the pockets 1108 by moving the scotch 1100 in the second direction (as indicated by the arrow 1114) when the cable reel 100 needs to be rotated to be transported to a new location or otherwise repositioned.

The scotch 1100 may be constructed of a metal, polymer, or other material that may allow the scotch 1100 to flex such that the stoppers 1104 can be deployed. As shown in FIG. 11A, the scotch 1100 may include curved portions 1112 that may facilitate flexing the scotch 1100 during use. In addition, a hinge 1116 (shown in FIG. 11B) or other mechanisms may be used to allow the scotch 1100 to bend and not cause binding between the axle 104 and the opening 1102. For example, the hinge 1116 may be placed proximate the curved portions 1112. The scotch 1100 may be made up of an upper half 1120 and a lower half 1122. The hinge 1116 may allow the lower half 1122 to be pulled away from the flange 108B so that the upper half 1120 of the scotch 1100 may traverse the axle 104 without binding.

While FIGS. 11A and 11B show the scotch 1100 mechanically fastened to the axle 104, still consistent with embodiments, the scotch 1100 may comprise magnetic fasteners that may facilitate securing the scotch 1100 to the cable reel 100, while still allowing the scotch 1100 to be repositioned. For example, magnets (not shown) may be attached or embedded within stoppers 1104. The magnets may allow the stoppers 1104 to adhere to a side of the flange 108B for storage. During deployment of the scotch 1100, the stoppers 1104 may be removed from the pockets 1108 and placed in a desired position.

Figure 12:
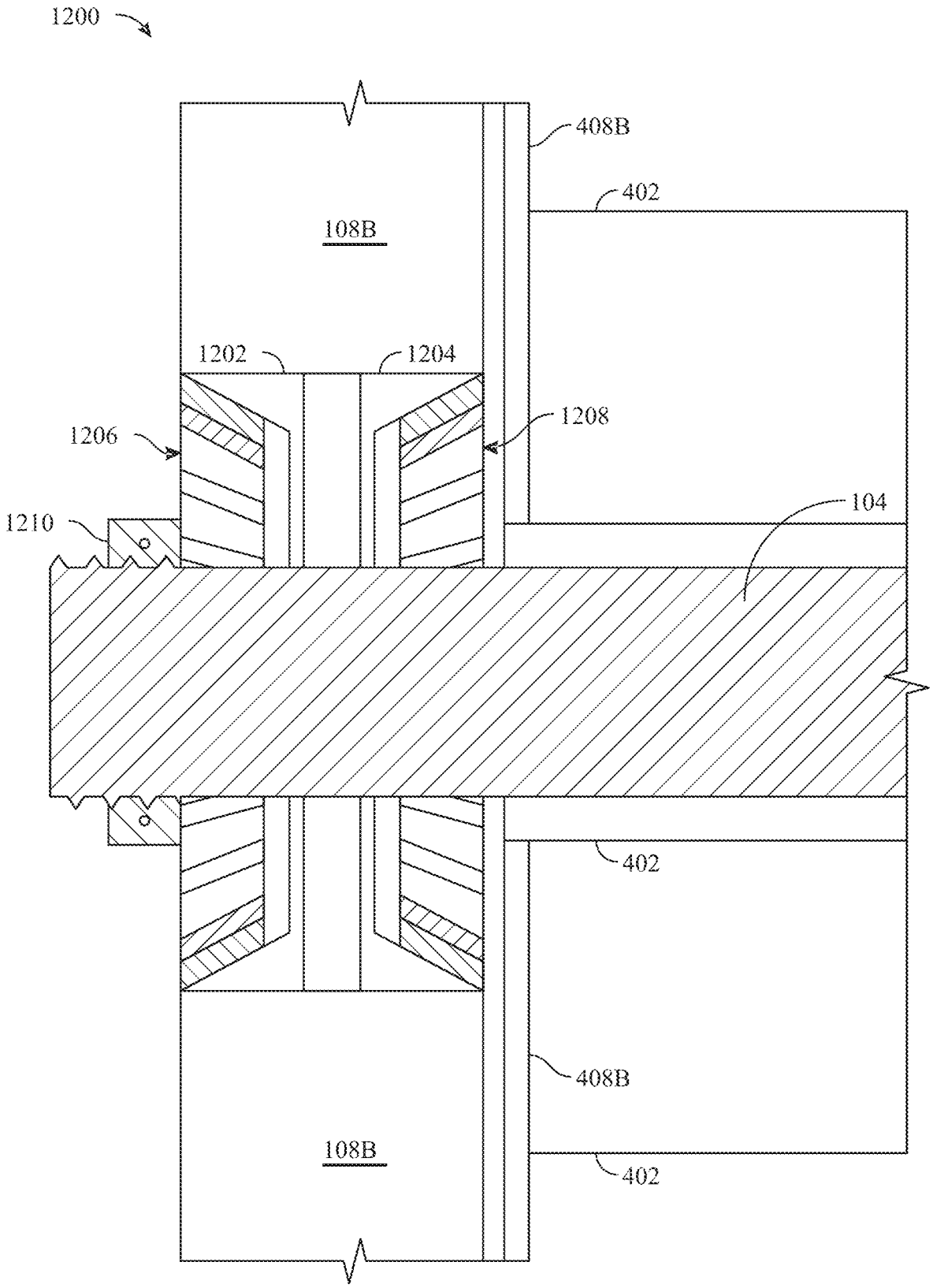
FIG. 12 shows a bearing assembly, according to exemplary embodiments.

FIG. 12 shows a bearing assembly 1200, according to an exemplary embodiment. The bearing assembly 1200 includes a first bearing 1202 and a second bearing 1204. The first bearing 1202 and the second bearing 1204 each includes a plurality of rollers 1206 and 1208, respectively.

The first bearing 1202 and the second bearing 1204 may be press fitted into a flange, such as the flange 108B. Although FIG. 12 illustrates a bearing assembly 1200 in association with the flange 108B, it should be understood that a second bearing assembly comprising the same configuration may be used in association with the flange 108A. The axle 104 passes through the first bearing 1202 and the second bearing 1204. A collar 1210 is used to secure the flange 108B to the axle 104. The collar 1210 may screw onto a treaded portion of the axle 104, be press fitted onto the axle 104, or may be bolted to the axle 104. During construction of the cable reel 100, the first bearing 1202 and the second bearing 1204 may slide over the axle 104. Due to possible imperfections within the first bearing 1202 and the second bearing 1204, the flange 108B may not have a tight fit with regards to the axle 104. In other words, the flange 108B may wobble on the axle 104 due to slack in the first bearing 1202 and the second bearing 1204. To remove the slack, the collar 1210 may press against the first bearing 1202, which may in turn press against the second bearing 1204. The increased pressure may cause the slack in the first and second bearings 1202, 1204 to diminish. In addition, when use of the first bearing 1202 and the second bearing 1204 causes wear, the collar 1210 may be readjusted to remove any slack that develops.

As illustrated by FIG. 12, the plurality of rollers 1206 and 1208 may be at an angle that is not parallel or perpendicular to the axle 104. For example, the first bearing 1202 and the second bearing 1204 may be tapered bearings. Having the plurality of rollers 1206 and 1208 at angles allows the first bearing 1202 and the second bearing 1204 to accommodate both radial and axial loads. As a result, use of tapered bearings, such as the first and second bearings 1202 and 1204, may allow the cable reel 100 to be constructed without having to have separate bearings to accommodate both radial and axial loads. Grease or other lubricants may be packed into the first bearing 1202 and the second bearing 1204 to decrease wear and reduce rolling resistance.

Figure 13:
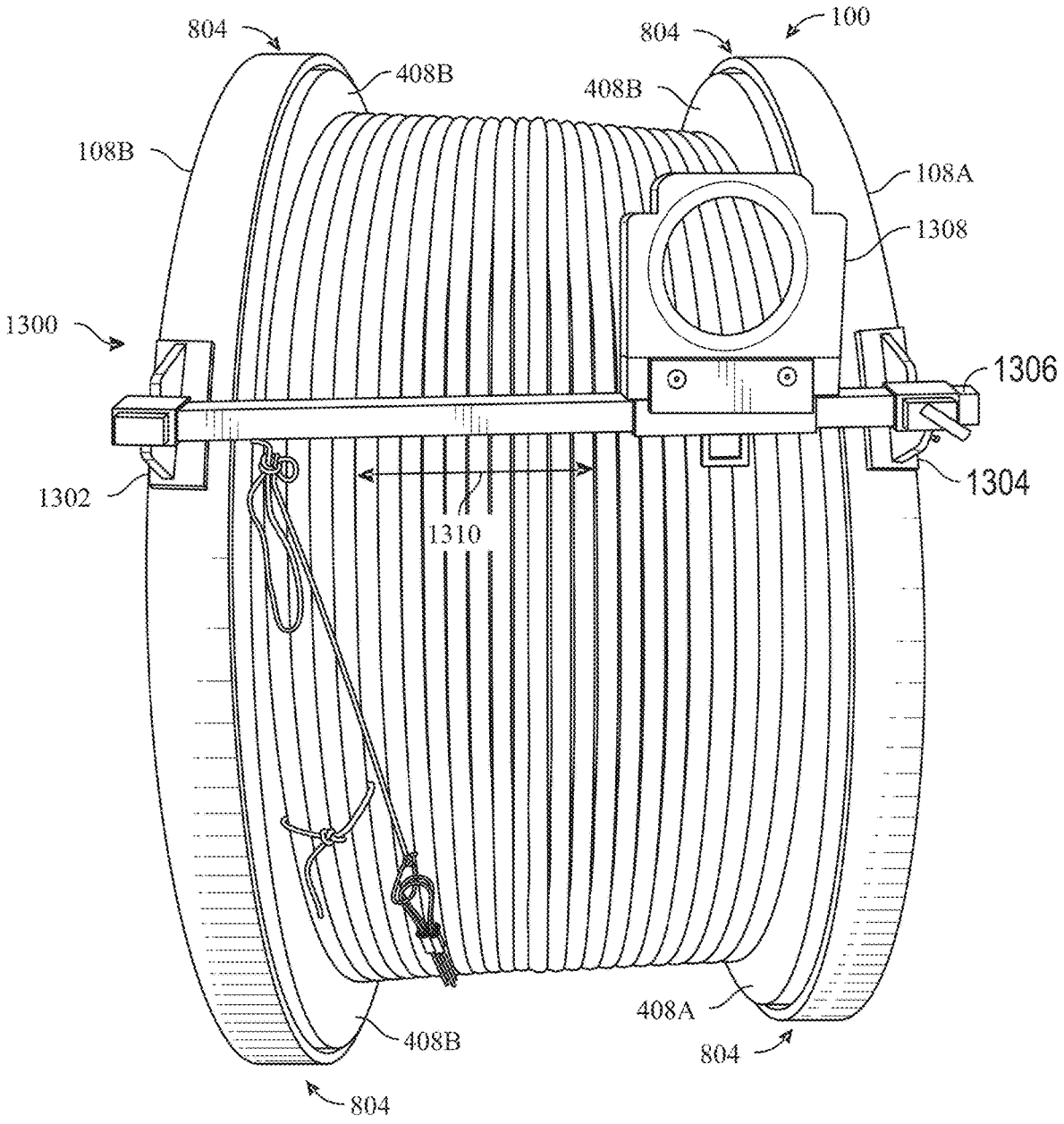
FIG. 13 shows a wire guide assembly, according to exemplary embodiments.

FIG. 13 shows a wire guide assembly 1300 attached to the cable reel 100, according to an exemplary embodiment. The wire guide assembly 1300 includes a first support 1302, a second support 1304, a cross-bar 1306, and a wire guide 1308. The first support 1302 and the second support 1304 are attached to the flanges 108A and 108B, respectively, as shown in greater detail with regards to the first support and the flange 108B in FIG. 14. During use, the drum 402 may rotate while the flanges 108A and 108B remain stationary. As the drum 402 rotates, cable, such as the cable 105 (not shown in FIG. 13), may pass through the wire guide 1308. In addition, during operation, the wire guide 1308 may oscillate as shown by arrow 1310 to help accommodate placement of the cable 105. The oscillation of the wire guide 1308 may be caused by a force acting on the wire guide 1308 by the cable. For example, as the cable passes through the wire guide 1308, the cable may strike a portion of the wire guide 1308 and cause the wire guide to move as indicated by arrow 1310. The movement of the wire guide 1308 by forces impacted from the cable may allow the wire guide 1308 to self-center around the wire guide 1308. Still consistent with various embodiments, the wire guide 1308 may have a fixed position on the cross-bar 1306. For instance, the wire guide 1308 may be fixed in the center of the cross-bar 1306.

Figure 14:
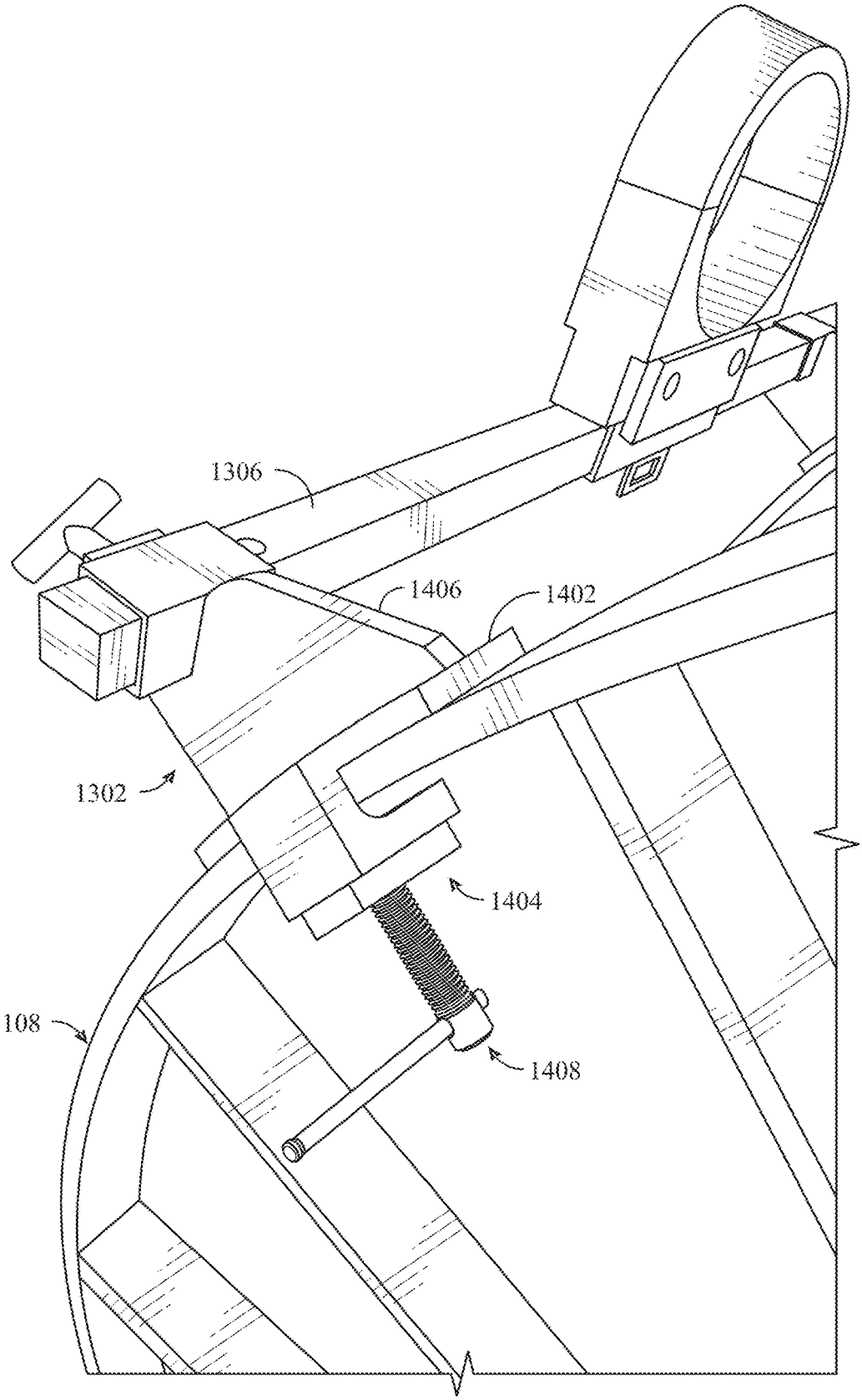
FIG. 14 shows a wire guide assembly support, according to exemplary embodiments.

FIG. 14 shows the first support 1302 attached to the flange 108A, according to an exemplary embodiment. The first support 1302 includes a plate 1402, a clamp 1404, and a cross-bar support 1406. During installation, the plate 1402 rests against a portion of the flange 108A, and a crank 1408 is used to tighten the clamp 1404 thereby securing the first support 1302 to the flange 108A. The cross-bar support 1406 extends from the plate 1402 and connects the cross-bar 1306 to the first support 1302. For example, the cross-bar 1306 may be bolted to the cross-bar support 1406 or may fit through an orifice (not shown) in the cross-bar support 1406.

Figure 15:
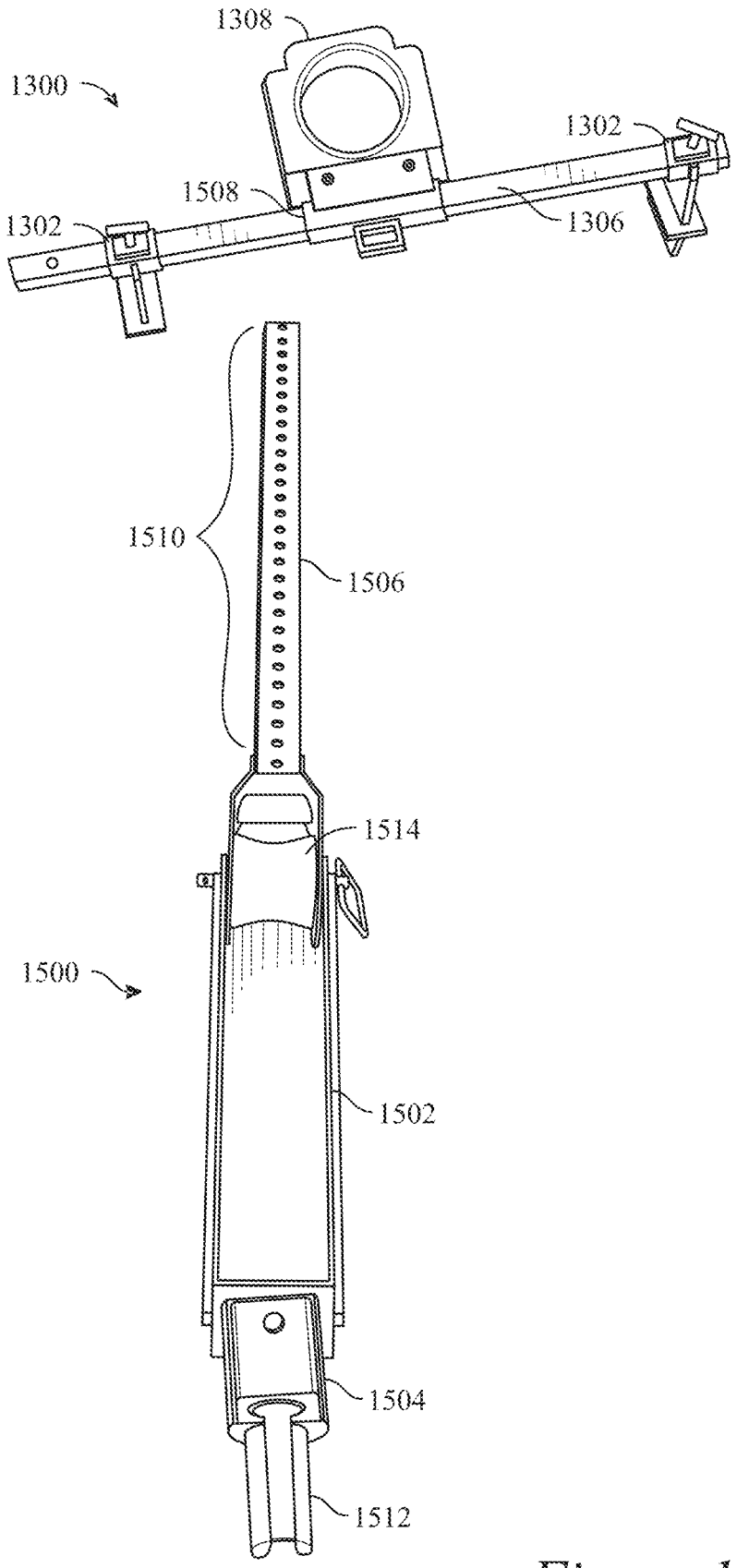
FIG. 15 shows a connector assembly, according to exemplary embodiments.

FIG. 15 shows a connector assembly 1500, according to an exemplary embodiment. The connector assembly 1500 includes a body 1502, a panel connection 1504, and a wire guide assembly connector 1506. During use, the wire guide assembly connector 1506 may pass through a bracket 1508 located on the wire guide assembly 1300. The wire guide assembly connector 1506 may be secured to the bracket 1508 using a pin (not shown) and a plurality of holes 1510 located in the wire guide assembly connector 1506. The panel connection 1504 connects to an electrical panel 1512. During use, the connector assembly 1500 helps to secure the cable reel 100 into position and keep the cable reel 100 from moving when the cable 105 is paid off the cable reel 100. The cable 105 may pass through the wire guide 1308 and over a roller 1514 before passing through the panel connector 1506. Once the cable 105 passes through the panel connector 1506, the cable 105 goes to the electrical panel 1512.

Figure 16:
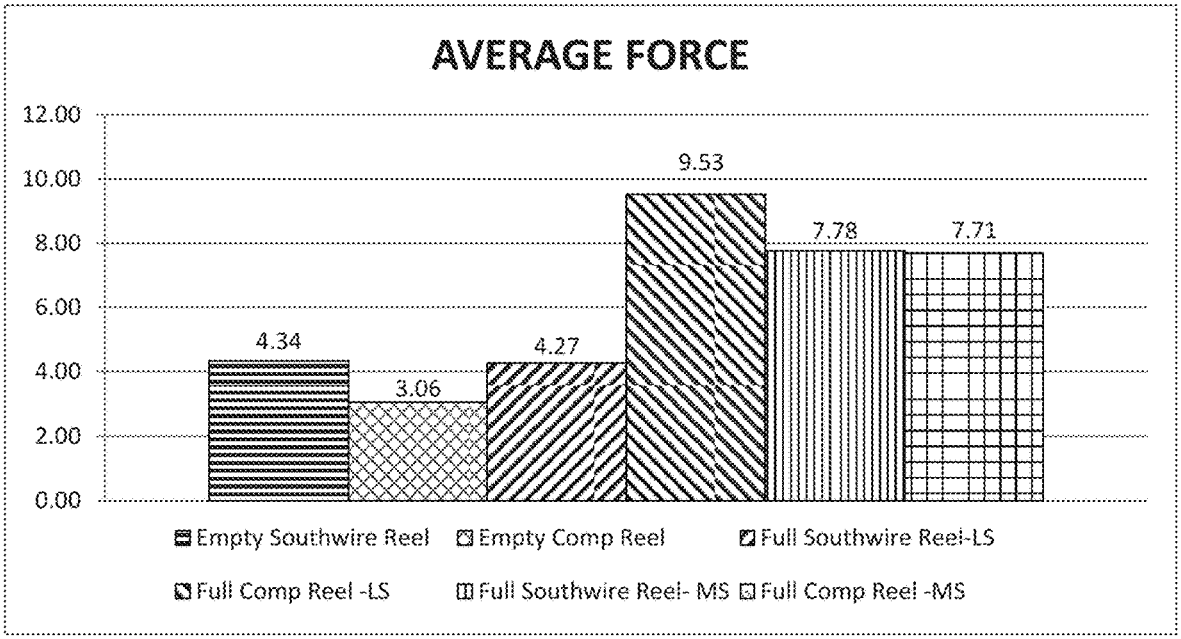
FIG. 16 shows a graph showing average forces needed to cause unassisted cable reel rotation, according to exemplary embodiments.

Exemplary embodiments of the cable reels, such as the cable reel 100, disclosed herein exhibit various characteristics that are an improvement over existing cable reels. FIG. 16 shows a graph illustrating an average force needed to cause a cable reel, such as the cable reel 100, to rotate from a stationary position through an angle of 90° for various configurations in comparison to an average force needed to cause an existing cable reel to rotate from a stationary position through an angle of 90°. One configuration includes an empty cable reel. An empty cable reel, as used herein, is a cable reel, such as the cable reel 100, with no wire or cable loaded onto the cable reel. A second configuration is a full cable reel. Examples of a full cable reel include, but are not limited to, a cable reel, such as the cable reel 100, having as much wire or cable as will fit on the cable reel, or a cable reel including an amount of wire or cable sold for a particular size reel. For example, a 48 inch cable reel may be sold with 2,500 feet of wire or cable installed. The 48 inch cable reel with 2,500 feet of wire or cable as sold would be considered a full cable reel.

The data in FIG. 16 is for cable reels, such as the cable reel 100, having a drum, such as the drum 402, of approximately 24 inches in diameter, flanges (e.g., flanges 108) of approximately 48 inches in diameter, and a traverse dimension of approximately 26 inches. The speed at which a cable reel is moved as well as the weight of the cable reel can impact the force required to move the cable reel. The weight of an empty cable reel, according to exemplary embodiments, for the data shown in FIG. 16 is approximately 573 pounds. The weight of a full cable reel, according to exemplary embodiments, for the data shown in FIG. 16 is approximately 2,339 pounds. The weight of an empty existing cable reel for the data shown in FIG. 16 is approximately 282 pounds and the weight of a full existing cable reel for the data shown in FIG. 16 is approximately 2081 pounds.

Table 1 shows a normalized average force needed to cause cable reels, such as the cable reel 100, to rotate from a stationary position through an angle of 90°. The normalized force is the force needed to cause motion of the cable reel divided by the weight of the cable reel. For example, for an empty cable reel according to exemplary embodiments, the average forced needed to cause an unassisted rotation of the flanges (e.g., flanges 108) from a stationary position through 90° for a 573 pound cable reel is about 4.34 pounds. Thus, the normalized average force needed to cause the unassisted rotation is 4.34 lbs divided by 573 lbs, which equals 0.0075. An unassisted rotation is a rotation where no machines or other equipment are used to rotate the drum or flanges of the cable reel. For unassisted rotation, a machine may be used to pull the wire or cable off the cable reel, but a machine or cable reel support may not be used to rotate the cable reel, the drum, or lift the cable reel into the air.

FIG. 16 and Table 1 show two full cable reel linear speeds, one being 10.5 feet per minute (LS) and the second being 55 feet per minute (MS). The linear speed is the speed along the ground an axle, such as the axle 104, traverses as flanges, such as the flanges 108, rotate. The procedure for collecting data used to form FIG. 16 and Table 1 is listed below. As shown in Table 1, the normalized forces for cable reels, such as the cable reel 100, according to exemplary embodiments are reduced as compared to the normalized forces for existing cable reels.

TABLE 1

| Normalized Average Force<br>Average Force | | | |
|---|---|---|---|
| | Empty | Full (LS) | Full (MS) |
| Cable Reel 100 | 0.00757 | 0.00183 | 0.00333 |
| Existing | 0.01085 | 0.00458 | 0.00370 |

Figure 17:
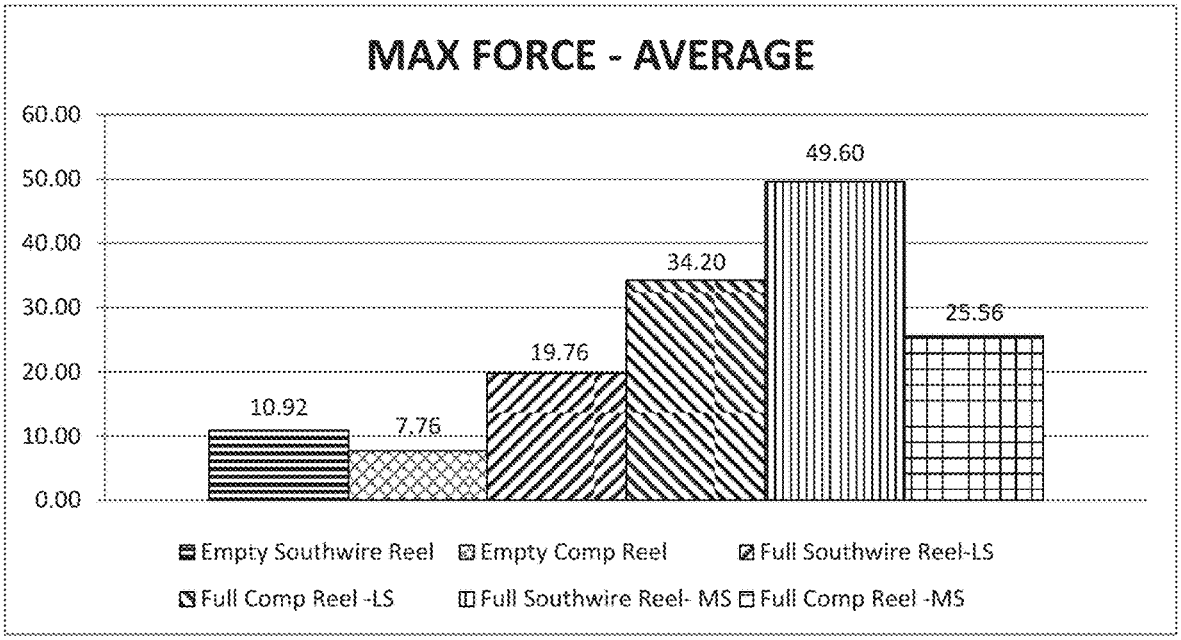
FIG. 17 shows a graph showing average maximum forces needed to cause unassisted cable reel rotation, according to exemplary embodiments.

FIG. 17 shows a graph showing an average maximum force needed to cause cable reels, such as the cable reel 100, to rotate from a stationary position through an angle of 90° for various configurations. One configuration includes an empty cable reel, or a cable reel with no wire or cable loaded onto the cable reel. A second configuration is a full cable reel.

The data in FIG. 17 is for cable reels, such as the cable reel 100, having a drum 402 of approximately 24 inches in diameter, flanges (e.g., flanges 108) of approximately 48 inches in diameter, and a traverse dimension of approximately 26 inches. Just as with the average force, the speed at which a cable reel is moved as well as the weight of the cable reel can impact the maximum force required to move the cable reel. The weight of an empty cable reel, according to exemplary embodiments, for the data shown in FIG. 17 is approximately 573 pounds. The weight of a full cable reel, according to exemplary embodiments, for the data shown in FIG. 17 is approximately 2,339 pounds. The weight of an empty existing cable reel for the data shown in FIG. 17 is approximately 282 pounds and the weight of a full existing cable reel for the data shown in FIG. 17 is approximately 2081 pounds.

Just as in Table 1, Table 2 shows normalized forces, (i.e., average maximum forces for multiple tests) needed to cause cable reels to rotate from a stationary position through an angle of 90°. The normalized maximum force is the force needed to cause motion of the cable reel divided by the weight of the cable reel. For example, for an empty cable reel according to exemplary embodiments, the maximum average force needed to cause an unassisted rotation of the flanges (e.g., flanges 108) from a stationary position through an angle of 90° for a 573 pound cable reel is about 10.92 pounds. Thus, the normalized maximum average force needed to cause the unassisted rotation is 10.92 lbs divided by 573 lbs, which equals 0.019.

FIG. 17 and Table 2 also show two full cable reel linear speeds, one being 10.5 feet per minute (LS) and the second being 55 feet per minute (MS). The linear speed is the speed along the ground an axle, such as the axle 104, traverses as flanges, such as the flanges 108, rotate. The procedure for collecting data used to form FIG. 17 and Table 2 is listed below.

TABLE 2

| Normalized Average Maximum Force<br>Max Force - Average | | | |
|---|---|---|---|
| | Empty | Full (LS) | Full (MS) |
| Cable Reel 100 | 0.01906 | 0.00845 | 0.02121 |
| Existing | 0.02752 | 0.01643 | 0.01228 |

Figure 18:
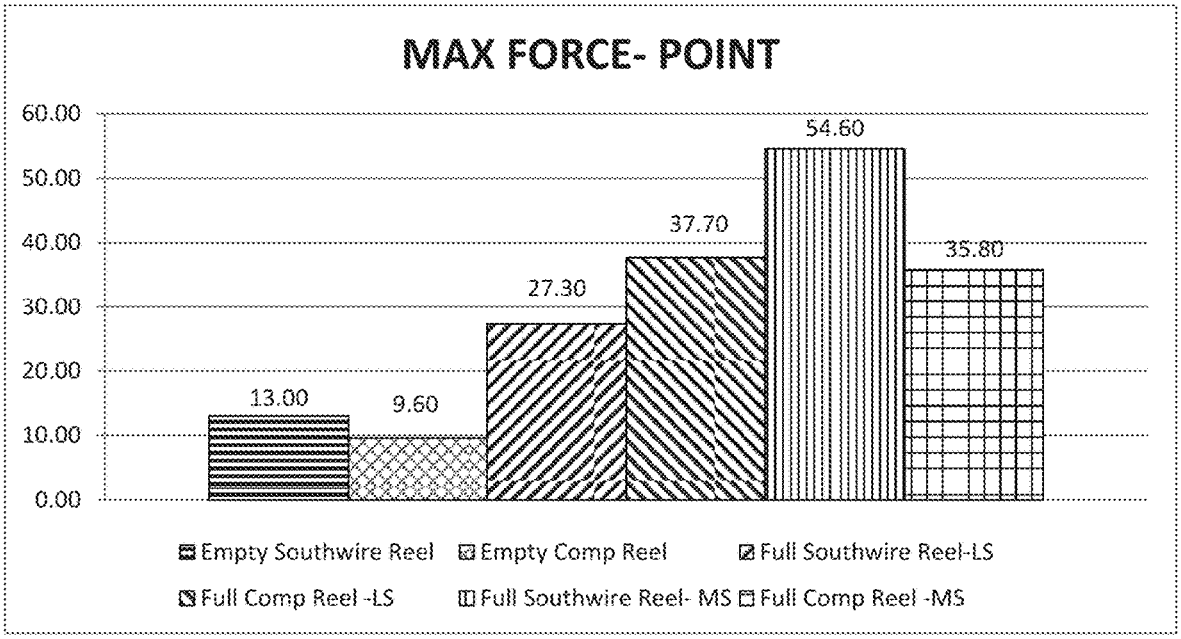
FIG. 18 shows a graph showing a maximum point force needed to cause unassisted cable reel rotation, according to exemplary embodiments.

FIG. 18 shows a graph showing a maximum point force needed to cause cable reels, such as the cable reel 100, to rotate from a stationary position through 90° for various configurations. The maximum point force is the maximum force experienced during a test. One configuration includes an empty cable reel, or a cable reel with no wire or cable loaded onto the cable reel. A second configuration is a full cable reel.

The data in FIG. 18 is for cable reels having a drum, such as the drum 402, of approximately 24 inches in diameter, flanges (e.g., flanges 108) of approximately 48 inches in diameter, and a traverse dimension of approximately 26 inches. Just as with the average force, the speed at which a cable reel is moved as well as the weight of the cable reel can impact the maximum force required to move the cable reel. The weight of an empty cable reel according to exemplary embodiments for the data shown in FIG. 18 is approximately 573 pounds. The weight of a full cable reel according to exemplary embodiments for the data shown in FIG. 18 is approximately 2,339 pounds. The weight of an empty existing cable reel for the data shown in FIG. 18 is approximately 282 pounds and the weight of a full existing cable reel for the data shown in FIG. 18 is approximately 2081 pounds.

Just as in Tables 1 and 2, Table 3 shows normalized forces (i.e., maximum forces exhibited for multiple tests) needed to cause cable reels to rotate from a stationary position through an angle of 90°. The normalized maximum point force is the force needed to cause motion of the cable reel divided by the weight of the cable reel. For example, for an empty cable reel according to exemplary embodiments, the maximum point force needed to cause an unassisted rotation of the flanges (e.g., flanges 108) from a stationary position through 90° for a 573 pound cable reel is about 13.00 pounds. Thus, the normalized maximum point force needed to cause the unassisted rotation is 13.00 lbs divided by 573 lbs, which equals 0.022.

FIG. 18 and Table 3 also show two full cable reel linear speeds, one being 10.5 feet per minute (LS) and the second being 55 feet per minute (MS). The linear speed is the speed along the ground the axle, such as the axle 104, traverses as the flanges, such as the flanges 108, rotate. The procedure for collecting data used to form FIG. 18 and Table 3 is listed below.

TABLE 3

| Normalized Maximum Force<br>Max Force - Point | | | |
|---|---|---|---|
| | Empty | Full (LS) | Full (MS) |
| Cable Reel 100 | 0.02269 | 0.01167 | 0.02334 |
| Existing | 0.03404 | 0.01812 | 0.01720 |

Figure 19:
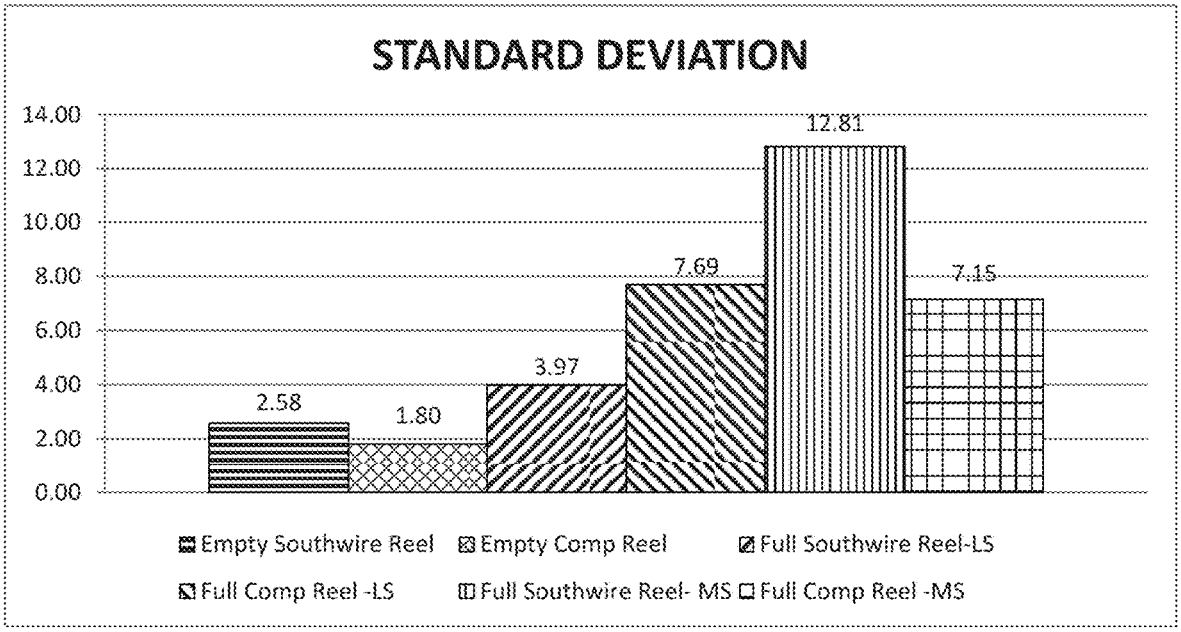
FIG. 19 shows a graph showing standard deviations for forces needed to cause unassisted cable reel rotation, according to exemplary embodiments.

FIG. 19 shows a graph showing a standard deviation for a force needed to cause cable reels, such as the cable reel 100, to rotate from a stationary position through an angle of 90° for various configurations. One configuration includes an empty cable reel, or a cable reel with no wire or cable loaded onto the cable reel. A second configuration is a full cable reel.

The data in FIG. 19 is for cable reels having a drum, such as the drum 402, of approximately 24 inches in diameter, flanges (e.g., flanges 108) of approximately 48 inches in diameter, and a traverse dimension of approximately 26 inches. Just as with the average force, the speed at which a cable reel is moved as well as the weight of the cable reel can impact the standard deviations. The weight of an empty cable reel according to exemplary embodiments for the data shown in FIG. 19 is approximately 573 pounds. The weight of a full cable reel according to exemplary embodiments for the data shown in FIG. 19 is approximately 2,339 pounds. The weight of an empty existing cable reel for the data shown in FIG. 19 is approximately 282 pounds and the weight of a full existing cable reel for the data shown in FIG. 19 is approximately 2081 pounds.

Table 4 shows a normalized data during unassisted rotations from a stationary position through an angle of 90°. The normalized data is the standard deviation divided by the weight of the cable reel. For example, for an empty cable reel according to exemplary embodiments, the standard deviation during rotation of the flanges (e.g., flanges 108) from a stationary position through 90° for a 573 pound cable reel is about 2.58 pounds. Thus, the normalized standard deviation during rotation is 2.58 lbs divided by 573 lbs, which equals 0.0045.

FIG. 19 and Table 4 also show two full cable reel linear speeds, one being 10.5 feet per minute (LS) and the second being 55 feet per minute (MS). The linear speed is the speed along the ground the axle traverses as the flanges rotate. The procedure for collecting data used to form FIG. 19 and Table 4 is listed below.

TABLE 4

| Normalized Standard Deviation Standard Deviation | | | |
|---|---|---|---|
| | Empty | Full (LS) | Full (MS) |
| Cable Reel 100 | 0.00450 | 0.00170 | 0.00548 |
| Existing | 0.00638 | 0.00370 | 0.00344 |

Figure 20:
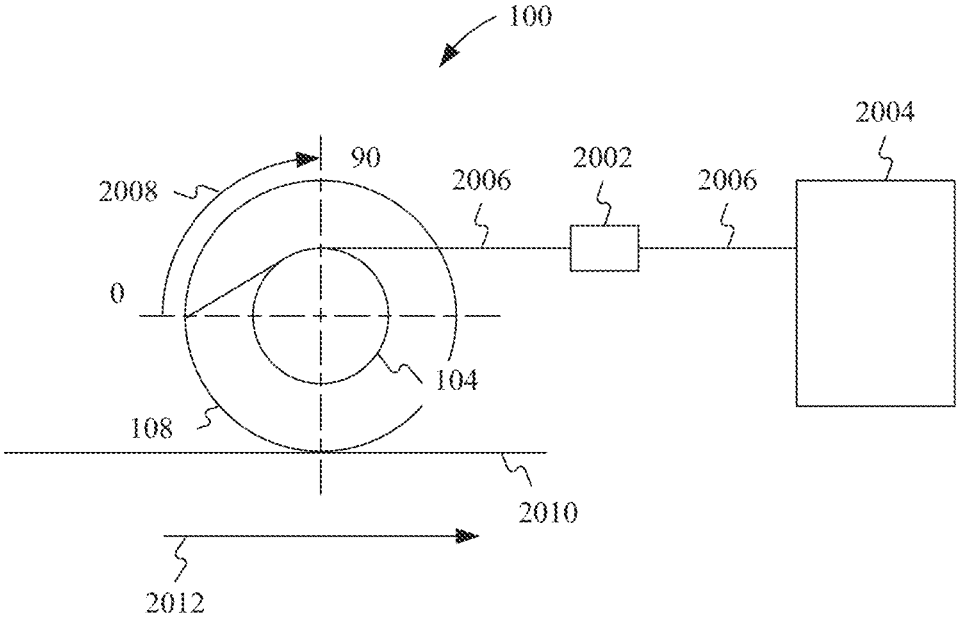
FIG. 20 shows a diagram for a data collection procedure, according to exemplary embodiments.

FIG. 20 shows a diagram for the procedure for acquiring the data shown in FIGS. 16-19. The procedure includes acquiring a cable reel, such as the cable reel 100, with a desired amount of wire or cable to be tested. For example, an empty cable reel might be selected or a full cable reel might be selected. A force gauge 2002 is connected to a puller 2004 and aligned with the center of the cable reel 100. The force gauge 2002 can be connected to a rope or other cable 2006 that is connected to the cable reel 100. For example, a block (e.g., a 2×4 piece of lumber) may be attached to the cable reel 100 via the flanges 108, and the rope or other cable 2006 may be connected to the block.

The rope or other cable 2006 is connected at a 0° angle as shown in FIG. 20. After everything is connected, the puller 2004 pulls the rope or other cable 2006 at a constant speed (e.g., 10.5 feet per minute or 55 feet per minute), and the force is recorded via the force gauge 2002. Data is recorded as the cable reel 100 rotates until the end of the rope or cable 2006 attached to the cable reel 100 has traveled 90° as shown by arrow 2008. During the testing, the axle 104 of the cable reel 100 may travel in a linear direction at a linear speed as shown by arrow 2012. During testing, a surface 2010 on which the cable reel 100 rolls should be smooth and approximately level.

Figure 21:
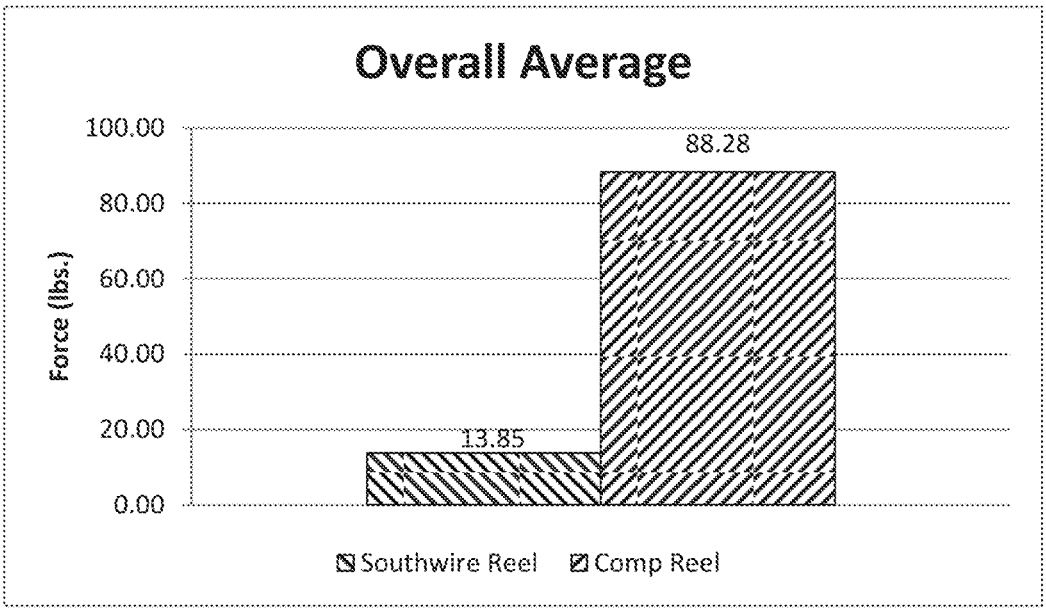
FIG. 21 shows a graph showing average forces needed to pull cable from a cable reel, according to exemplary embodiments.

FIG. 21 shows a graph showing an average force needed to pay off 241 inches of cable (e.g., SOUTHWIRE 550-37 compressed cable) from a full cable reel. A puller connected to a free end of the cable is used to pull 241 inches of cable from the full cable reel. The puller is set at the minimum speed for the puller (10.5 feet per minute). The data in FIG. 21 is for cable reels having a drum of approximately 24 inches in diameter, flanges (e.g., flanges 108) of approximately 48 inches in diameter, and a traverse dimension of approximately 26 inches. The weight of an empty cable reel according to exemplary embodiments for the data shown in FIG. 21 is approximately 573 pounds. The weight of a full cable reel according to exemplary embodiments for the data shown in FIG. 21 is approximately 2,339 pounds. The weight of an empty existing cable reel for the data shown in FIG. 21 is approximately 282 pounds and the weight of a full existing cable reel for the data shown in FIG. 21 is approximately 2081 pounds.

Figure 22:
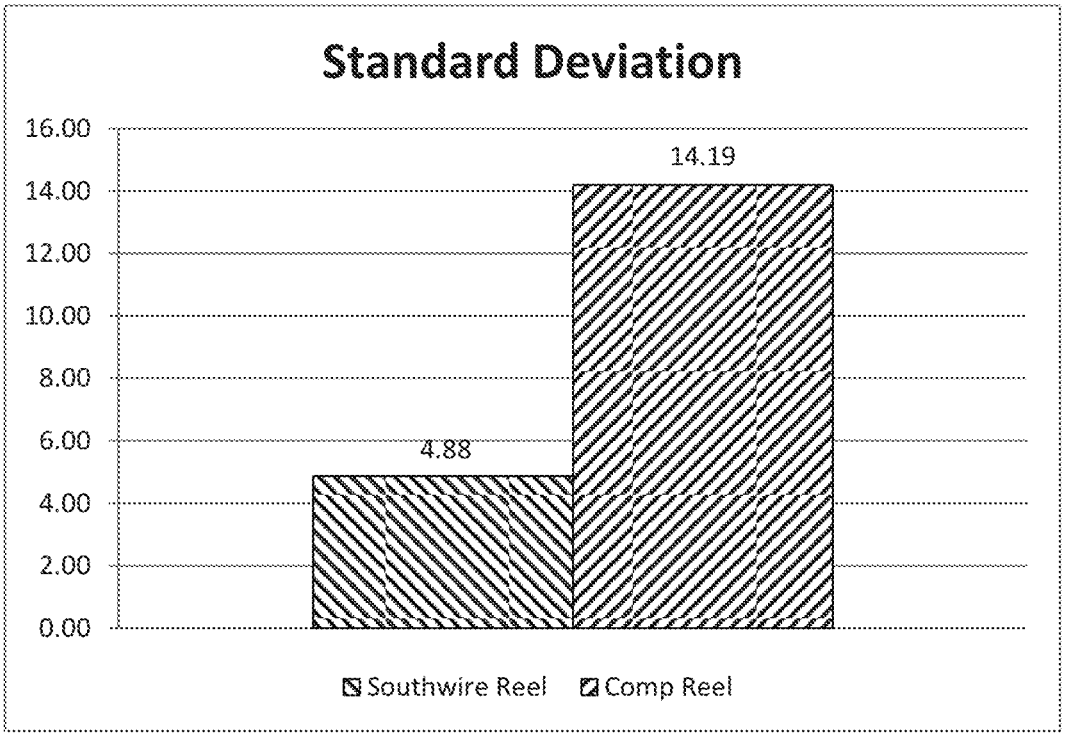
FIG. 22 shows the standard deviation for average forces needed to pull cable from a cable reel, according to exemplary embodiments.

As shown in FIG. 21, cable reels, such as the cable reel 100, according to exemplary embodiments experience a dramatic decrease in overall force required to pull wire or cable from the drum. Existing cable reels required on average of 88.28 pounds of force to pull 241 inches of cable, whereas cable reels, such as the cable reel 100, required on average of only 13.85 pounds of force to pull 241 inches of cable. In other words, existing cable reels require about 630 percent more force to pull the same length of cable. FIG. 22 shows the standard deviation for overall forces needed to pull cable from a cable reel. As shown in FIG. 22, the standard deviation for cable reels according to exemplary embodiments is substantially less than the standard deviation for existing cable reels. This difference, in conjunction with the data shown in at least FIGS. 21 and 23 (described below), provides confidence that cable reels, such as the cable reel 100, according to exemplary embodiments are far easier to use than existing cable reels.

Figure 23:
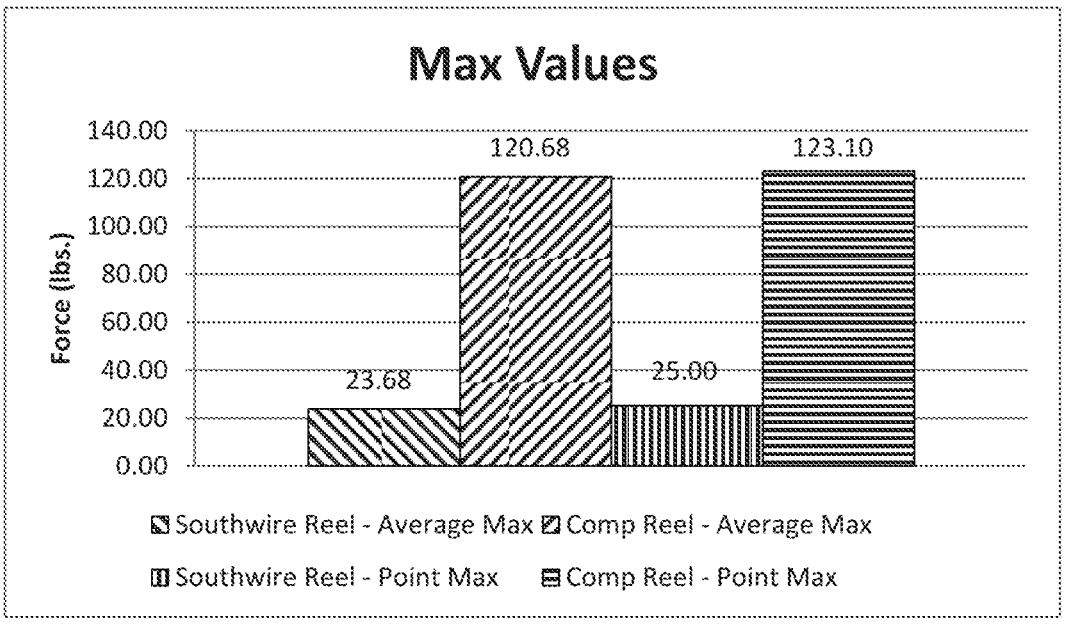
FIG. 23 shows a graph showing maximum forces needed to pull cable from a cable reel, according to exemplary embodiments.

FIG. 23 shows a graph showing maximum forces needed to pay off 241 inches of cable (e.g., SOUTHWIRE 550-37 compressed cable) from a full cable reel. A puller connected to a free end of the cable is used to pull 241 inches of cable from the full cable reel. The puller is set at the minimum speed for the puller (10.5 feet per minute). The data in FIG. 23 is for cable reels having a drum of approximately 24 inches in diameter, flanges (e.g., flanges 108) of approximately 48 inches in diameter, and a traverse dimension of approximately 26 inches. The weight of an empty cable reel according to exemplary embodiments for the data shown in FIG. 23 is approximately 573 pounds. The weight of a full cable reel according to exemplary embodiments for the data shown in FIG. 23 is approximately 2,339 pounds. The weight of an empty existing cable reel for the data shown in FIG. 23 is approximately 282 pounds and the weight of a full existing cable reel for the data shown in FIG. 23 is approximately 2081 pounds.

As shown in FIG. 23, cable reels according to exemplary embodiments experience a dramatic decrease in overall force required to pull wire or cable from the drum. For example, existing cable reels required on average a maximum point force (i.e., a highest force during testing) of 123.1 pounds of force to pull 241 inches of cable, whereas cable reels, such as the cable reel 100, showed on average a maximum point force of 25.00 pounds of force to pull 241 inches of cable. In other words, existing cable reels require about 492 percent more force to pull the same length of cable. Existing drums required an average maximum force (i.e., average maximum forces exhibited during testing) of 120.68 pounds of force to pull 241 inches of cable whereas cable reels according to exemplary embodiments required an average maximum force of 23.68 pounds of force to pull 241 inches of cable. In other words, existing cable reels require about 509 percent more force to pull the same length of cable.

Table 5 shows normalized data for the data shown in FIGS. 21-23. The normalized data is various forces or the standard deviation divided by the weight of the cable reel. For example, for a full cable reel according to exemplary embodiments, the average force needed to cause rotation of the drum to pay off 241 inches of cable for a 2339 pound cable reel is about 13.85 pounds. Thus, the normalized average force needed to cause the unassisted rotation is 13.85 lbs divided by 2339 lbs, which equals 0.0059. As shown in Table 5, existing cable reels, as compared to cable reels according to exemplary embodiments, require increases in normalized pulling forces ranging from about 550 percent to over 700 percent. The increase in normalized standard deviation is about 325 percent.

TABLE 5

| Normalized Wire Pull Data | | | | |
|---|---|---|---|---|
| | Average | Max (Average) | Max (Point) | STD |
| Cable Reel 100 | 0.00592 | 0.01012 | 0.01069 | 0.00209 |
| Existing | 0.04242 | 0.05799 | 0.05915 | 0.00682 |

The subject matter described above is provided by way of illustration only and should not be construed as limiting. Values disclosed may be at least the value listed. Values may also be at most the value listed. Various modifications and changes may be made to the subject matter described herein without following the example embodiments and applications illustrated and described, and without departing from the true spirit and scope of the claimed subject matter, which is set forth in the following claims.

What is claimed is:

1. A cable reel comprising:

an axle comprising a first end and a second end;

a drum affixed to the axle such that the drum and the axle rotate together, wherein the drum comprises a first flange and a second flange;

a third flange rotatably mounted on the axle proximate to the first end of the axle, wherein the third flange comprises a first lip, the first lip protruding from the third flange and extending past an edge of the first flange of the drum, the first lip creating a space between the first lip and the first flange; and a fourth flange rotatably mounted on the axle proximate to the second end of the axle.

2. The cable reel of claim 1, wherein the fourth flange comprises a second lip, the second lip protruding from the fourth flange and extending past an edge of the second flange of the drum, the second lip creating a space between the second lip and the second flange, and wherein the drum, the third flange, and the fourth flange are independently rotatable relative to one another.

3. The cable reel of claim 2, wherein each of the space between the first lip and the first flange and the space between the second lip and the second flange comprises a distance of about one-quarter of an inch.

4. The cable reel of claim 2, wherein the space between the first lip and the first flange comprises a distance to prohibit binding of the first flange with the third flange, and wherein the space between the second lip and the second flange comprises a distance to prohibit binding of the second flange and the fourth flange.

5. The cable reel of claim 1, wherein a normalized average amount of force required to cause an unassisted rotation of the third flange and the fourth flange from a stationary position through an angle of 90° is less than 0.00458, when the cable reel is loaded with a full amount of a cable and when a linear speed of the axle of the cable reel during the unassisted rotation is about 10.5 feet per minute, and wherein the normalized average amount of force required to cause the unassisted rotation of the third flange and the fourth flange from the stationary position through the angle of 90° is calculated by dividing an average amount of force required to cause the unassisted rotation of the third flange and the fourth flange from the stationary position through the angle of 90° by a weight of the cable reel loaded with the full amount of the cable.

6. The cable reel of claim 5, wherein the normalized average amount of force is at most 0.00183, and wherein the weight of the cable reel loaded with the full amount of the cable is at least 2339 pounds.

7. The cable reel of claim 1, wherein a normalized overall average amount of force required to pull, via a puller, about 241 inches of a cable from the cable reel when the cable reel is loaded with a full amount of the cable and when a speed of the puller is about 10.5 feet per minute is less than 0.04242.

8. The cable reel of claim 7, wherein the normalized overall average amount of force is at most 0.00592, and wherein a weight of the cable reel loaded with the full amount of the cable is at least 2339 pounds.

9. A cable reel comprising:

an axle comprising a first end and a second end;

a drum rotatably installed on the axle such that the drum and the axle are independently rotatable relative to one another, wherein the drum comprises a first flange and a second flange;

a third flange rotatably mounted on the axle proximate to the first end of the axle, wherein the third flange comprises a first lip, the first lip protruding from the third flange and extending past an edge of the first flange of the drum, the first lip creating a space between the first lip and the first flange; and a fourth flange rotatably mounted on the axle proximate to the second end of the axle.

10. The cable reel of claim 9, wherein the fourth flange comprises a second lip, the second lip protruding from the fourth flange and extending past an edge of the second flange of the drum, the second lip creating a space between the second lip and the second flange, and wherein the drum, the third flange, and the fourth flange are independently rotatable relative to one another.

11. The cable reel of claim 10, wherein each of the space between the first lip and the first flange and the space between the second lip and the second flange comprises a distance of about one-quarter of an inch.

12. The cable reel of claim 10, wherein the space between the first lip and the first flange comprises a distance to prohibit binding of the first flange with the third flange, and wherein the space between the second lip and the second flange comprises a distance to prohibit binding of the second flange and the fourth flange.

13. The cable reel of claim 9, wherein a normalized average amount of force required to cause an unassisted rotation of the third flange and the fourth flange from a stationary position through an angle of 90° is less than 0.00458, when the cable reel is loaded with a full amount of a cable and when a linear speed of the axle of the cable reel during the unassisted rotation is about 10.5 feet per minute, and wherein the normalized average amount of force required to cause the unassisted rotation of the third flange and the fourth flange from the stationary position through the angle of 90° is calculated by dividing an average amount of force required to cause the unassisted rotation of the third flange and the fourth flange from the stationary position through the angle of 90° by a weight of the cable reel loaded with the full amount of the cable.

14. The cable reel of claim 13, wherein the normalized average amount of force is at most 0.00183, and wherein the weight of the cable reel loaded with the full amount of the cable is at least 2339 pounds.

15. The cable reel of claim 9, wherein a normalized overall average amount of force required to pull, via a puller, about 241 inches of a cable from the cable reel when the cable reel is loaded with a full amount of the cable and when a speed of the puller is about 10.5 feet per minute is less than 0.04242.

16. The cable reel of claim 15, wherein the normalized overall average amount of force is at most 0.00592, and wherein a weight of the cable reel loaded with the full amount of the cable is at least 2339 pounds.

* * * * *